US005805965A

United States Patent [19]

Tsuda et al.

[11] Patent Number: 5,805,965

[45] Date of Patent: Sep. 8, 1998

[54] DEVELOPING DEVICE FOR AN IMAGE FORMING APPARATUS HAVING DEVELOPER DISTRIBUTION FEATURES

[75] Inventors: Kiyonori Tsuda, Tokyo; Seiji Oka, Yokohama; Hajime Oyama, Ichikawa; Yasushi Akiba, Tokyo, all of Japan

[73] Assignee: Ricoh Company, Ltd., Tokyo, Japan

[21] Appl. No.: 747,760

[22] Filed: Nov. 13, 1996

[30] Foreign Application Priority Data

| | | | |
|---|---|---|---|
| Nov. 14, 1995 | [JP] | Japan | 7-295079 |
| Nov. 20, 1995 | [JP] | Japan | 7-326507 |
| Nov. 20, 1995 | [JP] | Japan | 7-326516 |
| Dec. 21, 1995 | [JP] | Japan | 7-349819 |
| Feb. 29, 1996 | [JP] | Japan | 8-071492 |
| Oct. 15, 1996 | [JP] | Japan | 8-294349 |
| Oct. 22, 1996 | [JP] | Japan | 8-279527 |

[51] Int. Cl.[6] ..... G03G 15/08

[52] U.S. Cl. ..... 399/281; 399/279; 399/284

[58] Field of Search ..... 399/284, 286, 399/274, 276, 279, 281

[56] References Cited

U.S. PATENT DOCUMENTS

| | | |
|---|---|---|
| 4,650,070 | 3/1987 | Oka et al. . |
| 4,799,608 | 1/1989 | Oka . |
| 4,969,557 | 11/1990 | Oka . |
| 5,057,868 | 10/1991 | Sekino et al. . |
| 5,077,584 | 12/1991 | Tanaka et al. . |
| 5,109,254 | 4/1992 | Oka et al. . |
| 5,134,960 | 8/1992 | Shirai . |
| 5,187,326 | 2/1993 | Shirai . |
| 5,202,729 | 4/1993 | Miyamoto et al. . |
| 5,321,473 | 6/1994 | Azami . |
| 5,338,895 | 8/1994 | Ikegawa et al. . |
| 5,416,568 | 5/1995 | Yoshiki et al. . |
| 5,450,177 | 9/1995 | Oyama . |
| 5,585,895 | 12/1996 | Yashiro et al. . |

FOREIGN PATENT DOCUMENTS

| | | |
|---|---|---|
| 63-61275 | 3/1988 | Japan . |
| 63-197977 | 8/1988 | Japan . |
| 63-225269 | 9/1988 | Japan . |

OTHER PUBLICATIONS

Patent Abstracts of Japan, vol. 12, No. 203 (P–715), Jun. 11, 1988, JP–63–004282, Jan. 9, 1988.

Patent Abstracts of Japan, vol. 13, No. 27 (P–815), Jan. 20, 1989, JP–63–225266, Sep. 20, 1988.

Patent Abstracts of Japan, vol. 15, No. 368 (P–1253), Sep. 17, 1991, JP–03–144471, Jun. 19, 1991.

Patent Abstracts of Japan, vol. 15, No. 424 (P–1268), Oct. 28, 1991, JP–03–174175, Jul. 29, 1991.

Patent Abstracts of Japan, Vol. 10, No. 374 (P–527), Dec. 12, 1986, JP–61–166572, Jul. 28, 1986.

Patent Abstracts of Japan, vol. 10, No. 322 (P–511), Oct. 31, 1986, JP–61–129664, Jun. 17, 1986.

*Primary Examiner*—R. L. Moses

*Attorney, Agent, or Firm*—Oblon, Spivak, McClelland, Maier & Neustadt, P.C.

[57] ABSTRACT

A developing device of the type developing a latent image formed on an image carrier with a two-ingredient type developer, i.e., a mixture of toner and magnetic carrier particles is disclosed. The device is operable without a sophisticated toner content control mechanism or a sophisticated developer agitating and conveying mechanism, and is capable of obviating various problems ascribable to the increase in the toner content of the developer at the opposite end portions of a developer carrier. For this purpose, the device restricts the movement of a developer present on the developer carrier in the direction substantially perpendicular to the direction in which the developer carrier conveys the developer.

41 Claims, 17 Drawing Sheets

DEVELOPING DEVICE FOR AN IMAGE FORMING APPARATUS HAVING DEVELOPER DISTRIBUTION FEATURES

BACKGROUND OF THE INVENTION

The present invention relates to a developing device for a copier, facsimile apparatus, printer or similar image forming apparatus and, more particularly, to a developing device of the type developing a latent image formed on an image carrier with a two-ingredient type developer, i.e., a mixture of toner and magnetic carrier particles.

A developing device of the type described and capable of automatically controlling the toner content of a developer and the amount of charge to deposit on toner is disclosed in, e.g., Japanese Patent Laid-Open Publication Nos. 63-225266 and 64-105975. This kind of developing device effects the above control on the basis of the movement of the developer itself and eliminates the need for a sophisticated toner content control mechanism including a developer agitating and conveying member and a toner content sensor. This successfully reduces the size and cost of the developing device. However, the problem with such a developing device is that the amount of toner automatically replenished into the developer differs from a position where the movement of the developer is active to a position where it is inactive and from a position where the amount of the developer is great to a position where it is small. As a result, the toner content of the developer becomes irregular and brings about the irregular density and blur of an image. Particularly, the developer deposited on a developing sleeve or similar developer carrier moves in the direction substantially perpendicular to the direction in which the developer carrier conveys the developer. Consequently, the toner content of the developer increases at the opposite end portions of the developer carrier. This contaminates the background of an image, causes the toner to fly about, and lowers the density of an image.

In light of the above, Japanese Patent Laid-Open Publication No. 63-4282, for example, teaches a developing device including a toner hopper in which two toner feeding members are disposed. A developer is routed though the paths formed by the two toner feeding members so as to obviate the irregular density and blur of an image. This kind of approach, however, increases the size and cost of the developing device due to the two toner feeding members.

SUMMARY OF THE INVENTION

It is therefore an object of the present invention to provide a developing device operable without a sophisticated toner content control mechanism or a sophisticated developer agitating and conveying mechanism, and capable of obviating the above problems ascribable to the increase in toner content at the opposite end portions of a developer carrier by restricting the movement of a developer present on the developer carrier in the previously mentioned direction.

It is another object of the present invention to provide a small size, low cost and stable quality developing device by reducing the number of parts and integrating functions.

In one aspect of the present invention, a developing device includes a developer carrier for conveying a developer consisting of toner and magnetic particles and deposited thereon. A magnetic field generating section is disposed in the developer carrier. A regulating member regulates the amount of the developer deposited on the image carrier. A developer storing member forms between the developer storing member and the developer carrier a space for causing the developer blocked by the regulating member to stay. A toner storing section adjoins the space from the upstream side with respect to the direction in which the developer carrier conveys the developer toward the space, and is formed with an opening for toner replenishment facing the image carrier. A spread preventing member prevents the developer blocked by the regulating member from spreading outward in the axial direction of the developer carrier.

In another aspect of the present invention, a developing device includes a developer carrier for conveying a developer consisting of toner and magnetic particles and deposited thereon. A magnetic field generating section is disposed in the developer carrier. A regulating member regulates the amount of the developer deposited on the developer carrier. A developer storing member forms between the developer storing member and the developer carrier a space for causing the developer blocked by the regulating member to stay. A toner storing section adjoins the space from the upstream side with respect to the direction in which the developer carrier conveys the developer toward the space, and is formed with an opening for toner replenishment facing the image carrier. A pair of side walls protrude from the opposite end portions of the developer storing member with respect to the lengthwise direction of the developer storing member, and are positioned outside of an effective developing range in which a toner image can be effectively formed in a direction substantially perpendicular to the above direction. The surfaces of the side walls facing the surface of the developer carrier are spaced from the surface of the developer carrier by a distance capable of restricting the movement of the developer on the developer carrier in the direction substantially perpendicular to the direction in which the developer carrier conveys the developer.

In another aspect of the present invention, a developing device includes a developer carrier including a magnetic field generating section thereinside, and conveys a developer consisting of toner and magnetic particles and deposited thereon.

A first regulating member regulates the amount of the developer being conveyed by the image carrier. A space is provided for causing the developer scraped off by the first regulating member to stay. A toner storing section adjoins the space for feeding toner to the developer carrier. A second regulating member is disposed in the space upstream of the first regulating member with respect to the direction in which the developer carrier conveys the developer. The second regulating member is spaced from the developer carrier such that when the developer forming a layer on the developer carrier increases in thickness due to an increase in the toner content of the developer, the second regulating member restricts the increment of the developer. A condition in which the developer and toner contact each other is varied in accordance with the variation of the toner content of the developer on the developer carrier to thereby vary a condition in which the developer on the developer carrier takes in the toner.

In another aspect of the present invention, a developing device includes a developer carrier for conveying a developer consisting of toner and magnetic particles and deposited thereon. A first regulating member regulates the thickness of the developer forming a layer on the developer carrier and being conveyed by the developer carrier. A space is positioned upstream of the first regulating member in the direction in which the developer carrier conveys the developer, for receiving the developer. A toner storing section adjoins the space and includes an opening for feeding toner to the developer carrier. The opening is formed by a second regulating member and a surface facing the second regulating member and each having a preselected length and each being spaced a particular distance from the developer carrier. The opening provides communicating between the space and said toner storing section. The space between the second regulating member and the developer carrier and the space between the above surface and the developer carrier are selected such that the developer forms a thicker layer around the opening than on a part of the developer carrier moved away from the first regulating member.

In another aspect of the present invention, a developing device includes a space for causing a two-ingredient type developer consisting of toner and magnetic carrier particles to stay therein. A rotatable developer carrier faces an image carrier and includes a magnetic field generating section thereinside. A first regulating member regulates the thickness of the developer forming a layer on the developer carrier. A toner storing section includes a rotatable toner feeding member thereinside. The maximum distance between the inner wall of the space and the surface of the developer carrier facing it is greater than the radius of the developer carrier. The toner stored in the toner storing section in such a manner as to contact the developer is fed to the space due to the movement of the developer in the space.

In another aspect of the present invention, a developing device includes a space for causing a two-ingredient type developer consisting of toner and magnetic carrier particles to stay therein. A rotatable developer carrier faces an image carrier and includes a magnetic field generating section thereinside. A first regulating member regulates the thickness of the developer forming a layer on the developer carrier. A toner storing section includes a rotatable toner feeding member thereinside. A second regulating member is positioned upstream of a portion of the inner wall of the space having the maximum distance to the surface of the developer carrier with respect to the direction of rotation of the developer carrier, for regulating the amount of the developer to enter the space. The distance between the second regulating member and the surface of the developer carrier is twice to six times as great as the distance between the first regulating member and the surface of the developer carrier. The toner stored in the toner storing section in such a manner as to contact the developer is fed to the space due to the movement of the developer in said space.

In still another aspect of the present invention, a developing device includes a space for causing a two-ingredient type developer consisting of toner and magnetic carrier particles to stay therein. A rotatable developer carrier faces an image carrier and includes a magnetic field generating section thereinside. A first regulating member regulates the thickness of the developer forming a layer on the developer carrier. A toner storing section includes a rotatable toner feeding member thereinside. A second regulating member is positioned upstream of a portion of the inner wall of the space having the maximum distance to the surface of the developer carrier with respect to the direction of rotation of the developer carrier, for regulating the amount of the developer to enter the space. The free edge of the second regulating member is positioned at a higher level than the center of rotation of the developer carrier. The toner stored in the toner storing section in such a manner as to contact the developer is fed to the space due to the movement of the developer in the space.

In a further aspect of the present invention, a developing device includes a a developer carrier for conveying a developer consisting of toner and magnetic carrier particles and deposited thereon. A magnetic field generating section is disposed in the developer carrier. A regulating member regulates the amount of the developer deposited on the developer carrier. A space is provided for causing the developer blocked by the regulating member to stay therein. A toner storing section adjoins the space and stores toner therein. The toner remains in contact with the developer deposited on the developer carrier. The space has an inner bottom wall with respect to the direction of gravity inclined downward from the toner storing section side toward the developer carrier side.

BRIEF DESCRIPTION OF THE DRAWINGS

The above and other objects, features and advantages of the present invention will become apparent from the following detailed description taken with the accompanying drawings in which.

In the figures, identical reference numerals indicate identical structural elements.

DESCRIPTION OF THE PREFERRED EMBODIMENTS

Figure 1A:
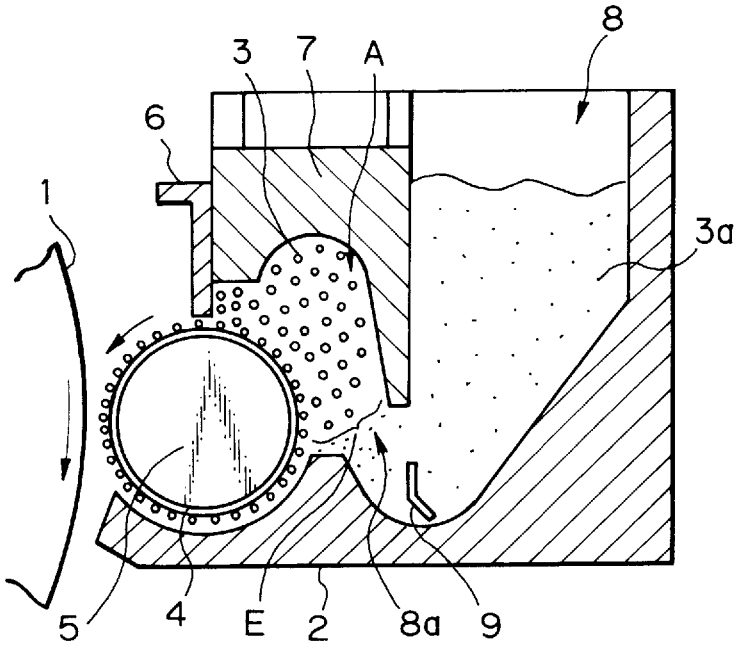
Fig. 1A PRIOR ART
FIG. 1A is a fragmentary section showing a conventional developing device.

To better understand the present invention, a brief reference will be made to a conventional developing device of the type developing a latent image with a two-ingredient type developer, shown in FIGS. 1A and 1B. The device to be described is capable of controlling the toner content and the amount of charge of the developer without resorting to a sophisticated toner content control mechanism including a developer agitating and conveying member and a toner content sensor. As shown in FIG. 1, the device includes a developer carrier 4 for carrying a developer 3 thereon. The developer 3 consists of toner 3*a* and magnetic carrier particles. Magnetic field generating means 5 is disposed in the developer carrier 4. A regulating member 6 regulates the amount of the developer 3 deposited on the developer carrier 4. A developer storing member 7 forms a space A between it and the developer carrier 4. The part of the developer 3 blocked by the regulating member 6 stays in the above space A. A toner storing section 8 adjoins the space A from the upstream side with respect to the direction in which the developer carrier 4 conveys the developer 3. An opening 8*a* is formed in the toner storing section 8 and faces the developer carrier 4. The toner content of the developer is determined mainly by the total amount of the carrier existing in the space A around the developer carrier 4. The reference numeral 9 designates an agitator.

Figure 1B:
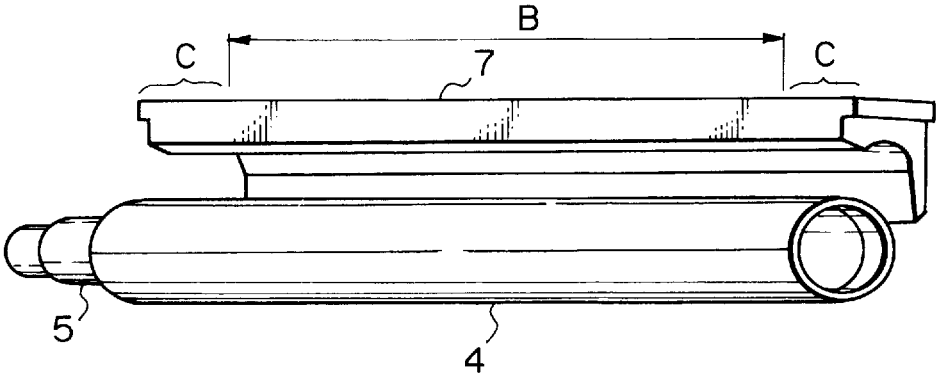
Fig. 1B PRIOR ART
FIG. 1B is a perspective view of the device shown in FIG. 1A.

As shown in FIG. 1B, the developer storing member 7 may be so configured as to surround a part of the periphery of the developer carrier 4 while forming the space A between it and the carrier 4. In the specific configuration, the lower end portion of the member 7 is also spaced from the periphery of the developer carrier 4. The developer 3 stays in the space A due mainly to the magnetic force of the magnetic field generating means 5. Generally, in a device of the type depositing a developer on a developer carrier on the basis of a magnetic field generated by magnetic field generating means, the developer exists on the developer carrier over the entire width of the magnetic field during conveyance. This is also true with the illustrative embodiment. Specifically, the developer 3 is conveyed by the developer carrier 4 to a position where the developer carrier 4 faces the regulating member 6, then to a position where the carrier 4 faces an image carrier 1, and then returned to the space A. The magnetic field generating means 5 forms a main pole and magnetic fields for allowing the developer 3 to be conveyed along the above path.

The major function of the developer storing member 7 is to form the space A in which the developer 3 stays due to the magnetic field formed by the magnetic field generating means 5. Therefore, the crux is that the member 7 has at least a wall covering the periphery of the developer carrier 4, as shown in FIG. 1B. Of course, a casing 2 shown in FIG. 1A includes opposite side walls spaced a distance greater than the axial dimension or length of the developer carrier 4, so that the toner is prevented from flying out of the developing device.

There are shown in FIG. 1B an effective developing range B and ranges C outside of the range B. A problem with the above configuration is that the developer 3 magnetically retained on the developer carrier 4 is apt to move from the range B to the ranges C in the direction substantially perpendicular to the direction of conveyance. In a developing device in which the force of the magnetic field generating means 5 for retaining the carrier of the developer 3 on the developer carrier 4 is far weaker in the ranges C than in the range B, the developer 3 moved to the ranges C drops due to its own weight. This reduces the total amount of the carrier determining the toner content of the developer 3. As a result, at portions facing the ranges C, fresh toner 3*a* is replenished from the toner storing section 8 into the space A in an amount corresponding to the decrement of the carrier, increasing the toner content to an excessive degree.

Figure 2A:
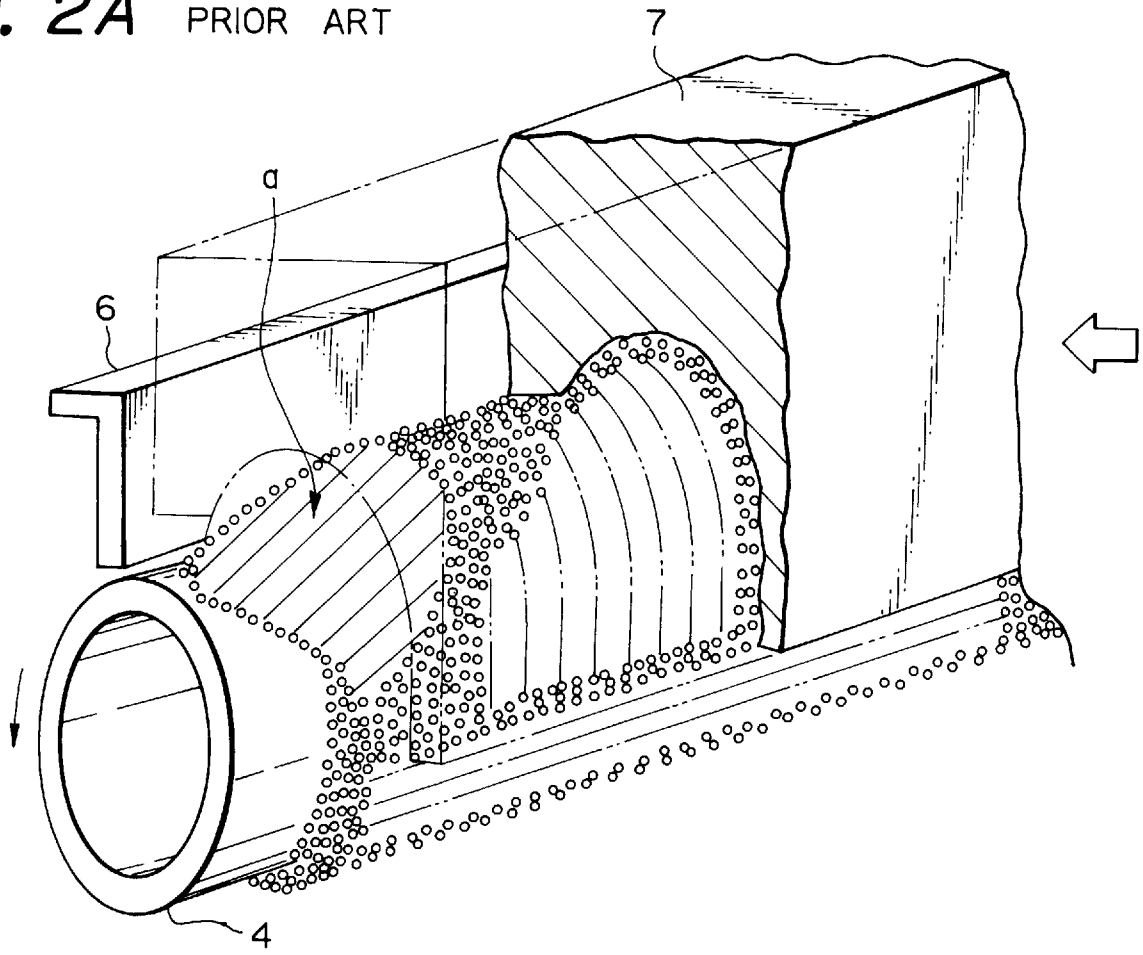
Fig. 2A PRIOR ART
FIG. 2A is a perspective view of the device of FIG. 1A, as seen in another direction.
Figure 2C:
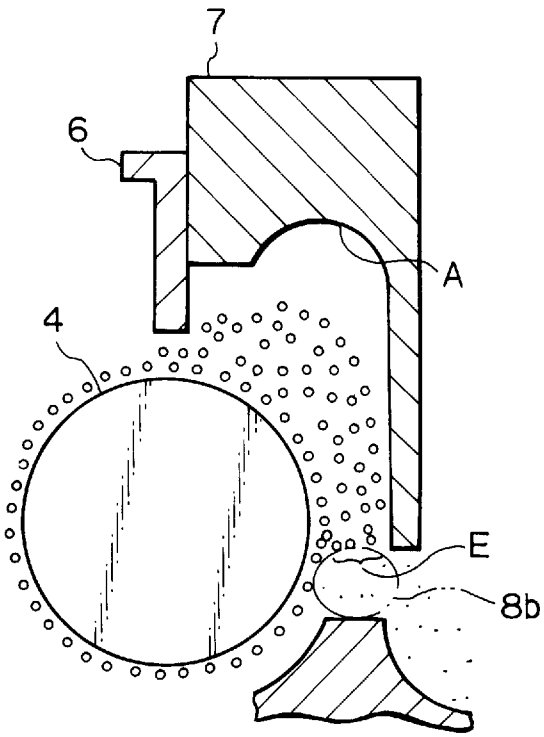
Fig. 2C PRIOR ART
FIG. 2C is a section along line X—X of FIG. 2B.
Figure 2B:
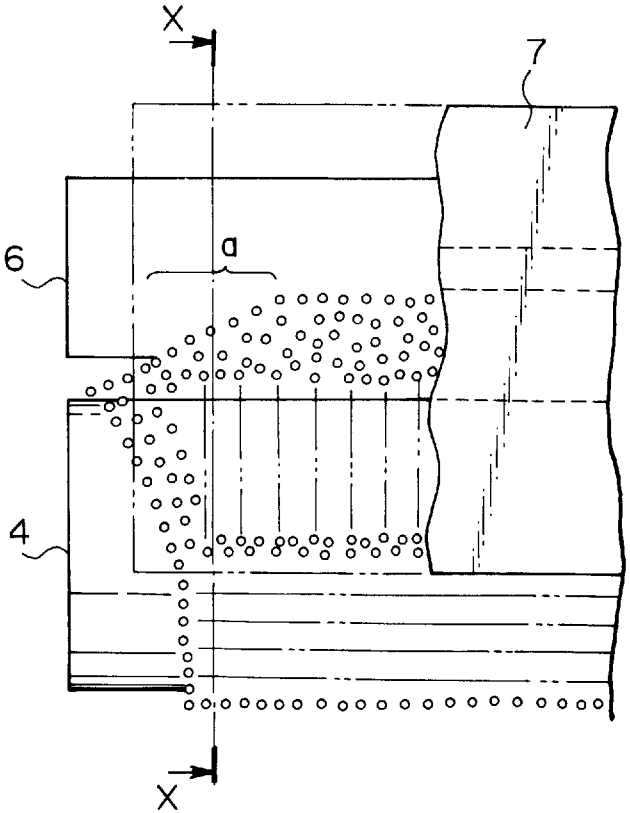
Fig. 2B PRIOR ART
FIG. 2B is a view of the device of FIG. 1A, as seen in a direction indicated by an outline arrow A shown in FIG. 2A.

FIGS. 2A–2C show another problem with the conventional developing device. As shown in FIGS. 2A and 2B, the part of the developer blocked by the regulating member 6 moves outward along the member 6 in the direction substantially perpendicular to the direction of conveyance. Consequently, the developer blocked by the regulating member 6 and expected to form a heap collapses at each end portion a of the developer carrier 4 and becomes lower at the end portion a than at the intermediate portion. As shown in FIG. 2C, toner 8*b* replenished via the opening 8*a* contacts the developer staying in the space A at a position E. In the above condition, the total amount of the carrier existing in the part of the space A upstream of the position E and corresponding to the end portion a is smaller than that of the carrier existing in the same part of the space A, but corresponding to the intermediate portion. As a result, at the position E, the developer behaves at the end portion a in such a manner as to take in the toner 8*b* easily. This also causes the toner 3*a* to be replenished from the toner storing section 8 into the space A more at the end portion a than at the intermediate portion, thereby increasing the toner content of the developer.

In a developing device of the type having a sophisticated toner content control mechanism including a toner content sensor, the developer blocked by the regulating member 6 also moves outward along the member 6 in the direction substantially perpendicular to the direction of conveyance. However, such a part of the developer does not directly effect the toner content of the developer.

The local increase in toner content in the axial direction of the developer carrier 4 reduces the chance that the toner is charged due to friction acting between it and the carrier, and thereby reduces the amount of charge to deposit on the toner. This reduces the electrostatic force restraining the toner on the carrier and causes the toner to contaminate the background of an image and to fly about and contaminate the interior of the image forming apparatus. Moreover, a magnet brush decreases at the opposite end portions of the developer carrier 4 and lowers the image density.

Preferred embodiments of the developing device in accordance with the present invention will be described hereinafter. The embodiments are applied to an electrophotographic copier by way of example.

1st Embodiment

Figure 3A:
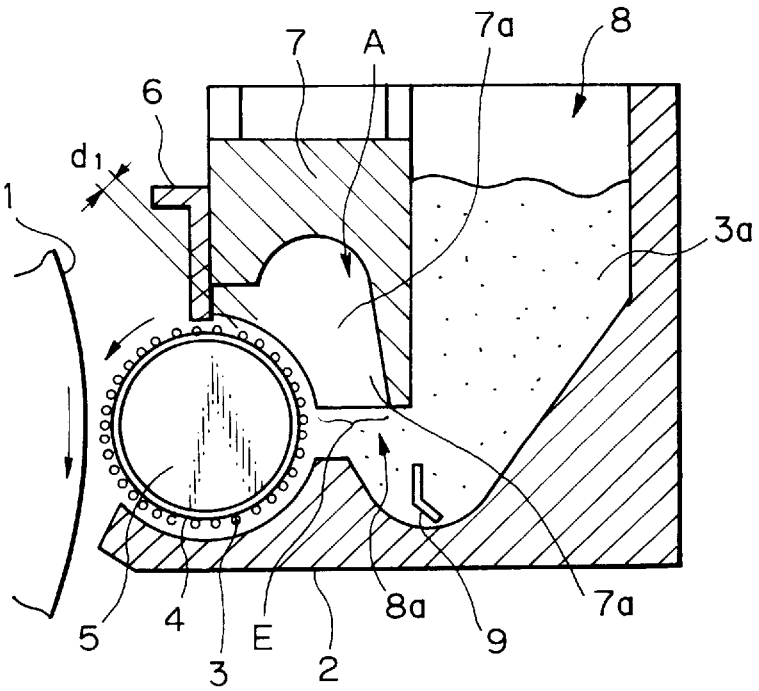
FIG. 3A is a fragmentary section showing a first embodiment of the developing device in accordance with the present invention.

Referring to FIG. 3A, a developing device includes a casing 2 located at one side of an image carrier implemented as a photoconductive drum 1. An opening is formed in a part of the casing 2 facing the drum 1. A nonmagnetic developing sleeve 4 is disposed in the casing 2 and partly exposed to the outside via the opening of the casing 2. The developing sleeve 4 plays the role of a developer carrier for depositing a two-ingredient type developer thereon. A magnet roller or magnetic field generating means 5 is fixed in place within the developing sleeve 4. A doctor blade or regulating member 6 regulates the amount of a developer 3 being conveyed by the developing sleeve 4 toward a developing position where the sleeve 4 faces the drum 1. A developer storing member 7 has an opening facing the developing sleeve 4.

The developer storing member 7 is positioned above the developing sleeve 4 and forms a space A between it and the sleeve 4. The part of the developer blocked by the doctor blade 6 stays in the above space A. The magnet roller 5 includes a magnetic pole forming a magnetic field which acts on the space A. In addition, the roller 5 includes a main pole facing the developing position and magnetic poles for allowing the sleeve 4 to convey the developer 3, as in the conventional developing device. A part of the casing 2 located at the right-hand side of the sleeve 4 forms a toner hopper 8 storing fresh toner 3*a* therein. An opening 8*a* is formed in the toner hopper 8. The opening 8*a* faces the sleeve 4 and adjoins the upstream side of the space A with respect to the direction in which the sleeve 4 conveys the developer 3. An agitator 9 adjoins the opening 8*a* and feeds the toner 3*a* toward the opening 8*a* while agitating it.

Figure 3B:
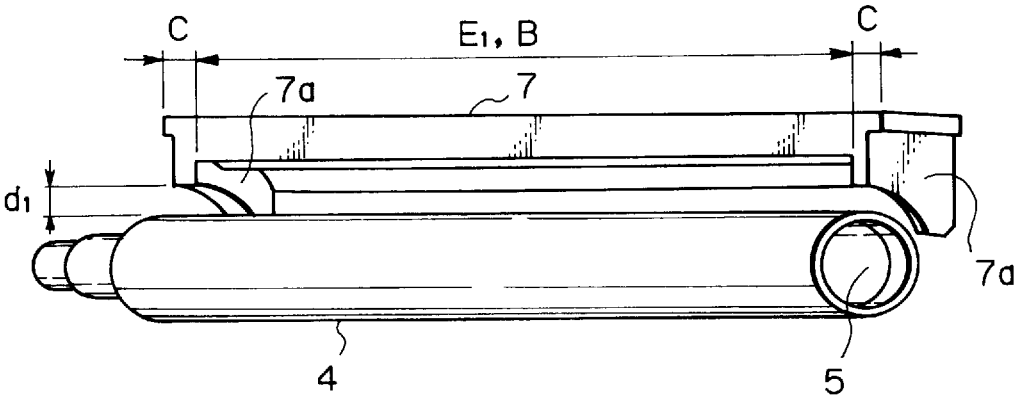
FIG. 3B is a perspective view showing characteristic features included in the first embodiment.

As shown in FIG. 3B, the developer storing member 7 has side walls 7*a* at opposite ends thereof. The side walls 7*a* protrude toward the sleeve 4 in order to prevent the developer 3 from moving sideways from an effective developing range B to ranges C outside of the range B. A gap d1 exists between the surface of each side wall 7*a* facing the sleeve 4 and the periphery of the sleeve 4. The gap d1 is so dimensioned as to restrict the movement of the developer, e.g., 0.5 mm to 2.0 mm.

Figure 4:
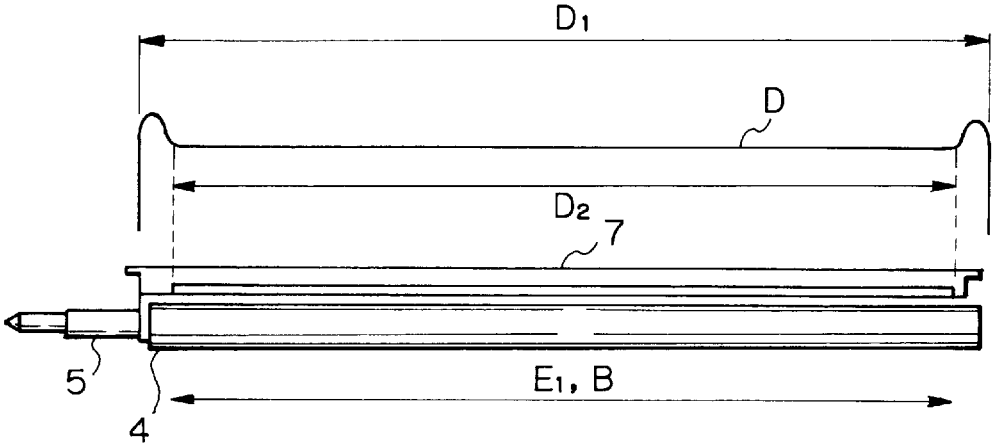
FIG. 4 shows a magnetic force distribution on a developing sleeve included in the first embodiment.

FIG. 4 shows a positional relation between the space A and the magnetic force distribution of the main pole in the axial direction of the sleeve 4. As a characteristic curve D indicates, the magnetic force of the sleeve 4 is slightly greater at the opposite end portions of the sleeve 4 than at the intermediate portion due to the property of the magnet roller 5. The sleeve 4 has an axial dimension or length greater than the width of an image, so that the opposite end portions of the sleeve 4 do not contribute to development. The side walls 7*a* correspond in position to the opposite end portions of the roller 5 where the magnetic force is intense. A seal may be fitted on each side wall 7*a* in order to fill the gap between the wall 7*a* and the sleeve 4, as will be described specifically later. For the seal, use may be made of sponge or or similar material. The developer storing member 7 is removably mounted to the body of the image forming apparatus and can be removed for the replacement of the developer 3.

Figure 5A:
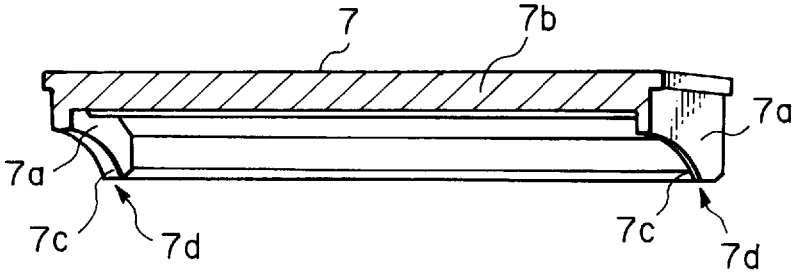
FIG. 5A shows the portions of a developer storing member, also included in the first embodiment, to which a seal is to be adhered.
Figure 5B:
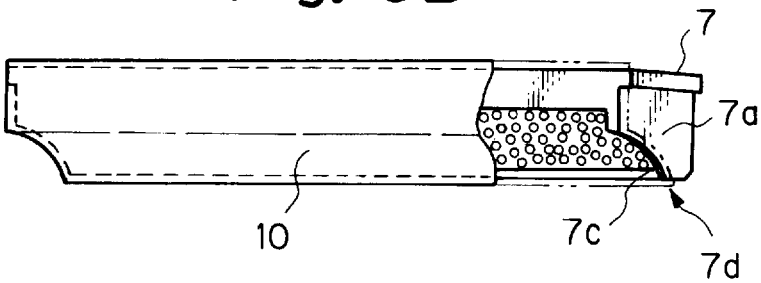
FIG. 5B is a view similar to FIG. 5A, showing the seal adhered to the developer storing member.

FIG. 5B shows the developer storing member or removable developer container 7 not mounted to the device body. As shown, the developer 3 is densely packed in the container 7 so as not to move sideways. A seal or developer holding member 10 closes an opening formed in the container 7. As shown in FIG. 5A, the seal 10 is adhered to surfaces 7*a*–7*b* included in the container 7 and indicated by hatching. The developer is packed in the container 7 in a uniform distribution in the lengthwise direction of the container 7.

In operation, while the sleeve 4 conveys the developer 3 in a direction indicated by an arrow, the doctor blade 6 regulates the developer 3 to form a thin developer layer. When the thin developer layer arrives at the developing position, the toner contained in the layer is transferred from the sleeve 4 to a latent image electrostatically formed on the drum 1. As a result, the latent image turns out a toner image. The part of the developer moved away from the developing position by the sleeve 4 takes in the fresh toner 3*a* at a position E where the toner 3*a* fed by the agitator via the opening 8*a* contacts the developer. The developer with the fresh toner 3*a* is returned to the space A. On reaching the doctor blade 6 again, the developer 3 has its internal pressure increased and causes the toner to be charged by the carrier. In this manner, the toner of the developer 3 deposited on the sleeve 4 is charged by the internal pressure of the developer staying in the space A. This eliminates the need for a complicated agitating and conveying mechanism including a paddle or a screw.

On the other hand, the developer 3 blocked by the doctor blade 6 is partly moved toward the opening 8*a* within the space A due to the internal pressure of the developer 3 and gravity. The developer 3 approached the opening 8*a* is recirculated toward the doctor blade 6 due to the rotation of the sleeve 4.

In the illustrative embodiment, as the replenishment of the toner to the developer 3 proceeds, the toner content and therefore the volume of the developer 3 increases. As a result, the developer 3 sequentially extends downward until it covers the opening 8*a*. As a result, the amount of replenishment of the toner to the developer 3 deposited on the sleeve 4 decreases, maintaining the toner content of the developer 3 below a preselected value. Conversely, when the toner content and therefore the volume of the developer 3 decreases, the developer 3 uncovers the opening 8*a*. As a result, a preselected amount of toner is replenished to the developer 3 existing on the sleeve 4, maintaining the toner content above a preselected value. In this manner, the toner content of the developer 3 is successfully controlled to a substantially constant range. This eliminates the need for a sophisticated toner content control mechanism including an optical sensor responsive to the density of a reference toner image, a toner replenishing member, etc.

The gap existing between each side wall 7*a* and the sleeve 4 and dimensioned, e.g., 0.5 mm to 2.0 mm prevents the developer 3 from moving from the intermediate portion to the opposite end portions of the sleeve 4. This prevents the developer 3 from dropping from the opposite end portions of the sleeve 4. When a seal is fitted on each side wall 7*a* and surely fills the above gap, the above movement of the developer 3 will be more surely restricted.

In the vicinity of the doctor blade 6, the side walls 7*a* prevent the developer 3 blocked by the blade 6 from spreading in the axial direction of the sleeve 4, as shown in FIGS. 2A–2C, with their inner surfaces. Also, the side walls 7*a* located at the opposite sides of the space A each extends from the position E to the doctor blade 6 along the periphery of the sleeve 4. This prevents the developer blocked by the doctor blade 6 from spreading in the axial direction of the sleeve 4 over to the above position E. At the same time, the side walls 7*a* delimit the widthwise range of the space A in which the developer exists.

The force of the magnet roller 5 acts over the entire widthwise range E1 of the sleeve 4 delimited by the inner surfaces of the side walls 7*a*. Therefore, the developer can be magnetically retained on the sleeve 4 over the entire range E1 and can be confined in the width delimited by the side walls 7*a*. In addition, the developer can be uniformly retained on the sleeve 4 over the entire range E1. This is because only a uniform magnetic force acts on the sleeve 4, as indicated by a range D2 in FIG. 4. In FIG. 4, D1 indicates the entire range over which the magnetic force acts.

When the developer 3 is to be replaced due to, e.g., deterioration, the operator should only lift the the container 7 away from the apparatus body, empty it, and then mount a new container 7 filled with a fresh developer 3. Thereafter, the operator removes the seal 10 from the new container 7 with the result that the developer 3 is uniformly set on the sleeve 4 in the lengthwise direction of the sleeve 4.

As stated above, the illustrative embodiment implements a small size, low cost developing device capable of controlling the toner content of the developer and charging the toner without resorting to a sophisticated toner content control mechanism or a sophisticated developer agitating and conveying mechanism.

The developer 3 deposited on the sleeve 4 is prevented from moving to and dropping from the opposite end portions of the sleeve 4. This obviates a decrease in the total amount of the carrier which determines the toner content. If the lateral movement of the developer is not restricted, then the toner content will increase to an unexpected degree and bring about various troubles stated earlier. The seals fitted on the side walls 7*a* as stated previously will restrict the above movement of the developer more positively.

In the vicinity of the doctor blade 6, the side walls 7*a* prevent the developer 3 blocked by the blade 6 from spreading in the axial direction of the sleeve 4, as shown in FIGS. 2A–2C, with their inner surfaces. This prevents the toner from flying about due to the increase in the toner content of the developer in the space A.

The side walls 7*a* delimit the widthwise range in which the developer exists in the space A. If the distance between the side walls 7*a* is greater than the width of the developer magnetically retained on the sleeve 4 and cannot delimit the above range, then the developer at the end portions of the sleeve 4 will collapse and locally become short in amount. The resulting increase in toner content at the end portions will cause the toner to fly about.

If the widthwise range E1, FIG. 3B, is substantially coincident with the effective developing range B, it is possible to effect substantially uniform development over the effective developing range with the developer deposited on the sleeve 4 and desirably controlled in toner content in the widthwise direction.

To set the developer 3 in the space A, the operator should only mount the container 7 to the apparatus body and then remove the seal from the container 7. This makes the operation easier than when such a developer is accommodated in the apparatus body from the above or the side of the apparatus body. Moreover, only if the seal is removed, the developer is set uniformly in the space A in the axial direction of the sleeve 4. This promotes efficient setting and eliminates the need for a special implementation for uniformalizing the developer 3 in the axial direction of the sleeve 4.

2nd Embodiment

Figure 6A:
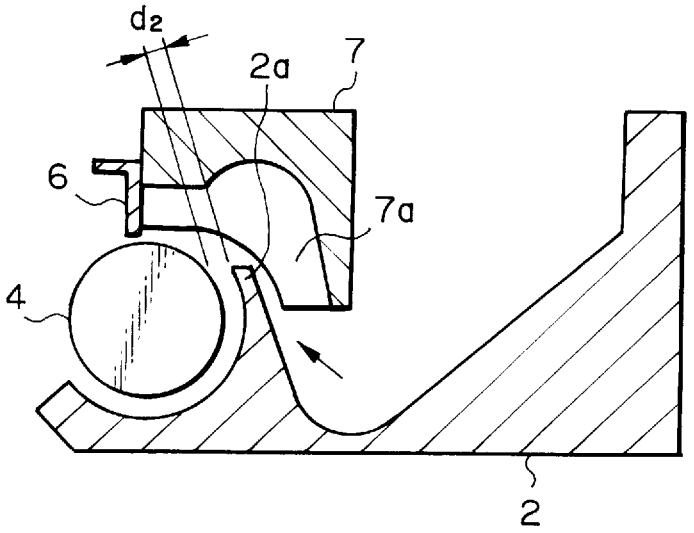
FIG. 6A is a fragmentary section showing a second embodiment of the present invention.
Figure 6B:
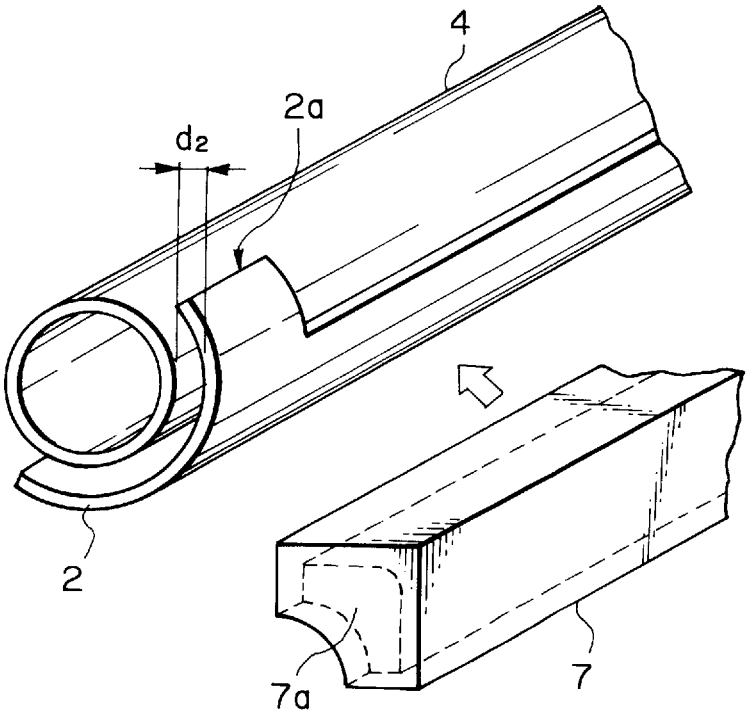
FIG. 6B is an exploded perspective view of the second embodiment.
Figure 7A:
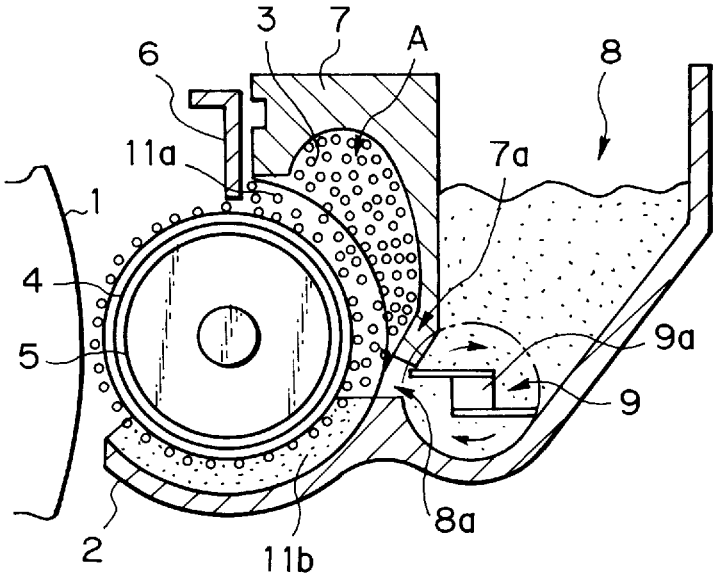
FIG. 7A is a fragmentary section showing a third embodiment of the present invention.
Figure 7B:
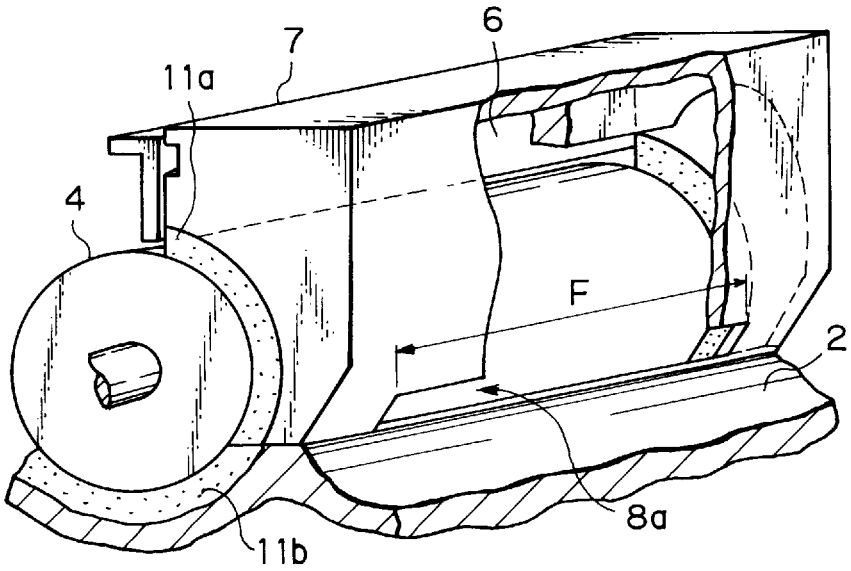
FIG. 7B is a perspective view of the third embodiment.

Referring to FIGS. 6A and 6B, a developing device includes projections 2*a* (only one is shown) protruding from the bottom of the casing 1 to the downstream side in the direction of conveyance. The projections 2*a* are surrounded by the side walls 7*a* and the periphery of the sleeve 4. The projections 2*a* and sleeve 4 are spaced a preselected distance d2 from each other. Preferably, each projection 2*a* has a thickness between 0.1 mm and 2.0 mm, as measured in the radial direction of the sleeve 4, while the distance d2 is between 0.5 mm and 2.0 mm.

In this embodiment, the side walls 7*a* also prevent the developer 3 from dropping in the ranges C outside of the effective developing range and where the magnetic force of the magnet roller 5 does not act on the developer 3. In addition, the projections 2*a* restrict the toner 3*a* tending to flow from the toner hopper 8 into the space A via the gaps between the side walls 7*a* and the projections 7*a* in the above ranges C. This successfully prevents the toner 3*a* from flowing out of the toner hopper 8 in an excessive amount and increasing the toner content of the developer 3 in the space A.

3rd Embodiment

FIGS. 7A, 7B, 8A and 8B show a developing device including seals 11*a* adhered to the surfaces of the side walls 7*a* facing the sleeve 4. The seals 11*a* have the same width as the side walls 7*a* and have a thickness filling the gaps between the side walls 7*a* and the sleeve 4. With this configuration, the device prevents the developer from moving from the intermediate portion to the end portions of the sleeve 4. Seals 11*b* similar to the seals 11*a* are adhered to the bottom portion of the casing 2 below the sleeve 4 and at positions corresponding to the seals 11*a*. The seals 11*b* fill the gaps between the casing 2 and the sleeve 4. The wall of the developer storing member 7 separating the space A and toner storing section 8 is extended downward and held in contact with the bottom portion of the casing 2, fully dividing the space A and section 8 from each other. The opening 8*a* is implemented as a slot formed in a part of the above wall of the member 7 and having a dimension smaller than the distance between the inner surfaces of the side walls 7*a*.

Figure 8A:
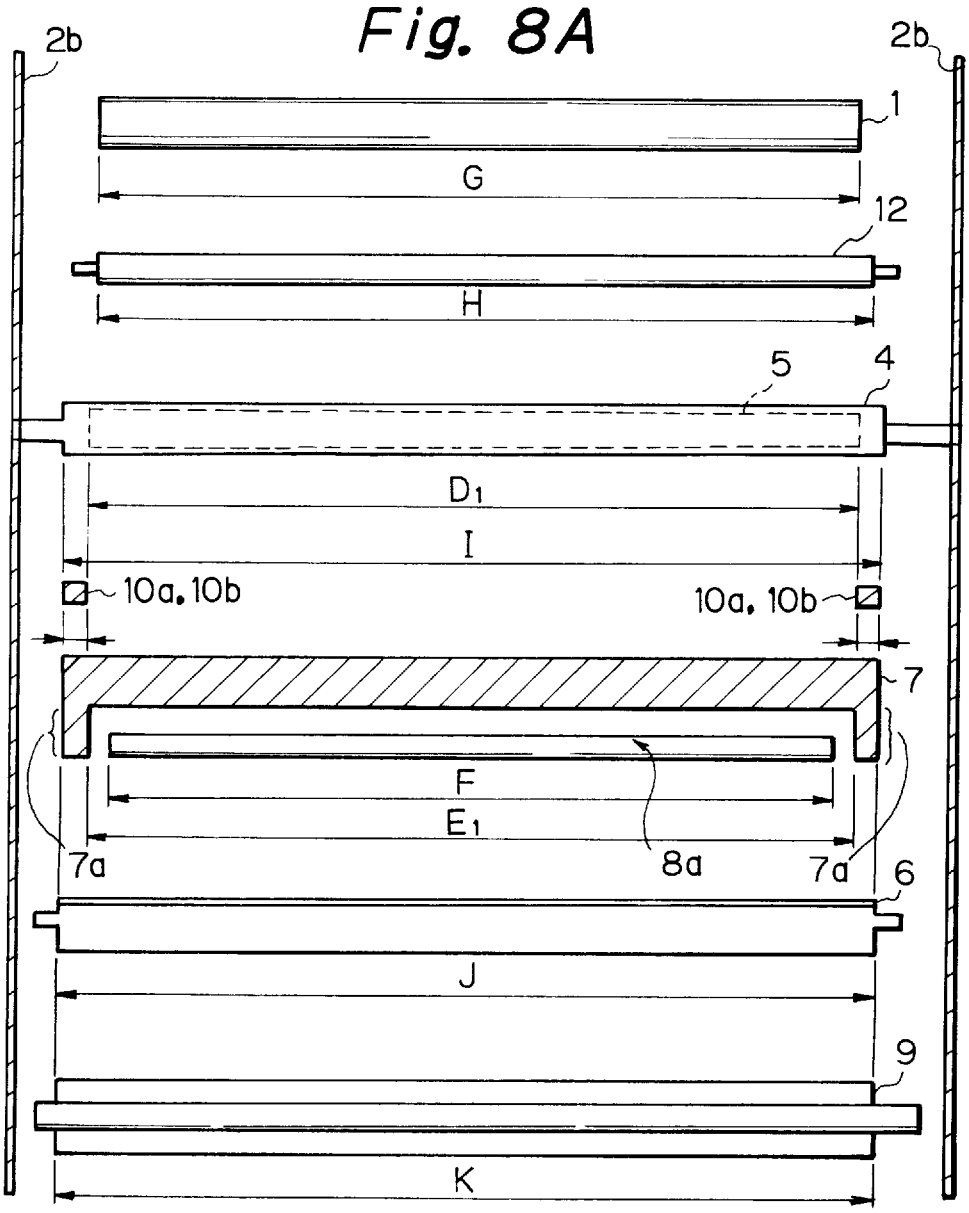
FIG. 8A shows the widths of various members included in the third embodiment.

As shown in FIG. 8A, in the illustrative embodiment, the sleeve 5, developer storing member 7, doctor blade 6 and agitator 9 are so dimensioned and positioned as to lie between the opposite side walls 2*b* of the casing 2. For example, assuming that the distance between the side walls 2*b* is 370 mm, then the width I of the sleeve 4, the distance between the outer surfaces of the side walls 7*a*, the width J of the doctor blade 6 and the width K of the agitator 9 are selected to be 318 mm. The distance E1 between the inner surfaces of the side walls 7*a* is coincident with the widthwise range D1 of the magnet roller 5 which is about 304 mm. The opening or slot 8*a* has a widthwise range F smaller than the above range E1. Also shown in FIG. 8A are the drum 1 and a charge roller 12 for charging it uniformly. The drum 1 and charge roller 12 are so dimensioned as to lie in the range of the sleeve 4. For example, the drum 1 and charge roller 12 have axial dimensions of 300 mm and 312 mm, respectively.

Figure 8B:
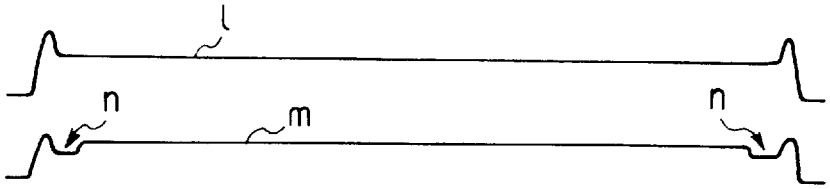
FIG. 8B shows a magnetic force distribution and a developer distribution particular to the third embodiment.

Because the distance E1 between the inner surfaces of the side walls 7*a* and the axial dimension D1 of the magnet roller 5 are coincident, a magnetic force distribution having peaks at its opposite ends occur in the space A, as indicated by a line l in FIG. 8B. As a result, the developer concentrates on the opposite end portions of the space A, as indicated by a line m in FIG. 8B. Consequently, the developer decreases at portions n adjoining, but inside of, the end portions. Therefore, it is likely that the toner content of the developer increases at the portions n. To solve this problem, in the illustrative embodiment, the opening 8*a* is reduced in size so as to obstruct the replenishment of the toner to the portions of the sleeve 4 corresponding to the above portions n.

As described above, the first to third embodiments have various unprecedented advantages, as enumerated below.

(1) A small size, low cost developing device is realized which is capable of controlling the toner content of the developer and charging the toner without resorting to a sophisticated toner content control mechanism or a sophisticated developer agitating and conveying mechanism.

(2) A spread preventing member obviates an occurrence that a developer blocked by a regulating member and forming a heap collapses and spreads outward in the lengthwise direction of a developer carrier and decreases in amount in the end portions of the developer carrier. This would otherwise contaminate the background of an image, cause toner to fly and lower image density due to an increase in toner content.

(3) The spread preventing member functions in the above-described manner over the entire width of a space where the developer stays. This further enhances the above advantage.

(4) The spread preventing member functions in the above-described manner over a range extending from the regulating member to a position where the toner replenished via an opening stays in contact with the developer staying the above space. This further enhances the above advantage.

(5) Two spread preventing members are positioned at both sides of the above space in order to prevent the developer from decreasing in amount and prevent the powder pressure from deceasing at a part of the space in the direction of developer conveyance or at the above contact position. This obviates an occurrence that the developer behaves at the contact position in such a manner as to take in the toner easily and increases its toner content. This would otherwise bring about the problems mentioned in (2).

(6) The developer is allowed to enter the space smoothly from the side upstream of the contact position in the direction of developer conveyance. This frees the developer from deterioration, compared to a case wherein a relatively heavy stress acts on the developer in the event of entry in the above space.

(7) There is obviated an occurrence that an irregular magnetic force distribution acting on the space locally increases the toner content of the developer in the widthwise direction and thereby brings about the problems mentioned in (2).

(8) The developer deposited on the developer carrier is prevented from moving to and dropping from the opposite end portions of the developer carrier. This obviates a decrease in the total amount of the carrier which determines the toner content. If the lateral movement of the developer is not restricted, then the toner content will increase to an unexpected degree and bring about various troubles stated earlier.

(9) Seals fitted on the side walls fill the gaps between the side walls and the periphery of the developer carrier. This restricts the movement of the developer on the developer carrier in the direction substantially perpendicular to the direction of conveyance more positively.

(10) To set the developer in the space, the operator should only mount the developer storing member to the apparatus body and then remove a seal from the storing member. This makes the operation easier than when such a developer is accommodated in the apparatus body from the above or the side of the device body. Moreover, only if the seal is removed, the developer is set uniformly in the space in the axial direction of the developer carrier. This promotes efficient setting and eliminates the need for a special implementation for uniformalizing the developer in the axial direction of the developer carrier.

(11) Projections protruding from the bottom of a device body restrict the toner tending to flow from the toner storing section into the space via the gaps between the side walls and the projections. This successfully prevents the toner from flowing out of the toner storing section in an excessive amount and increasing the toner content of the developer in the space.

4th Embodiment

Figure 9:
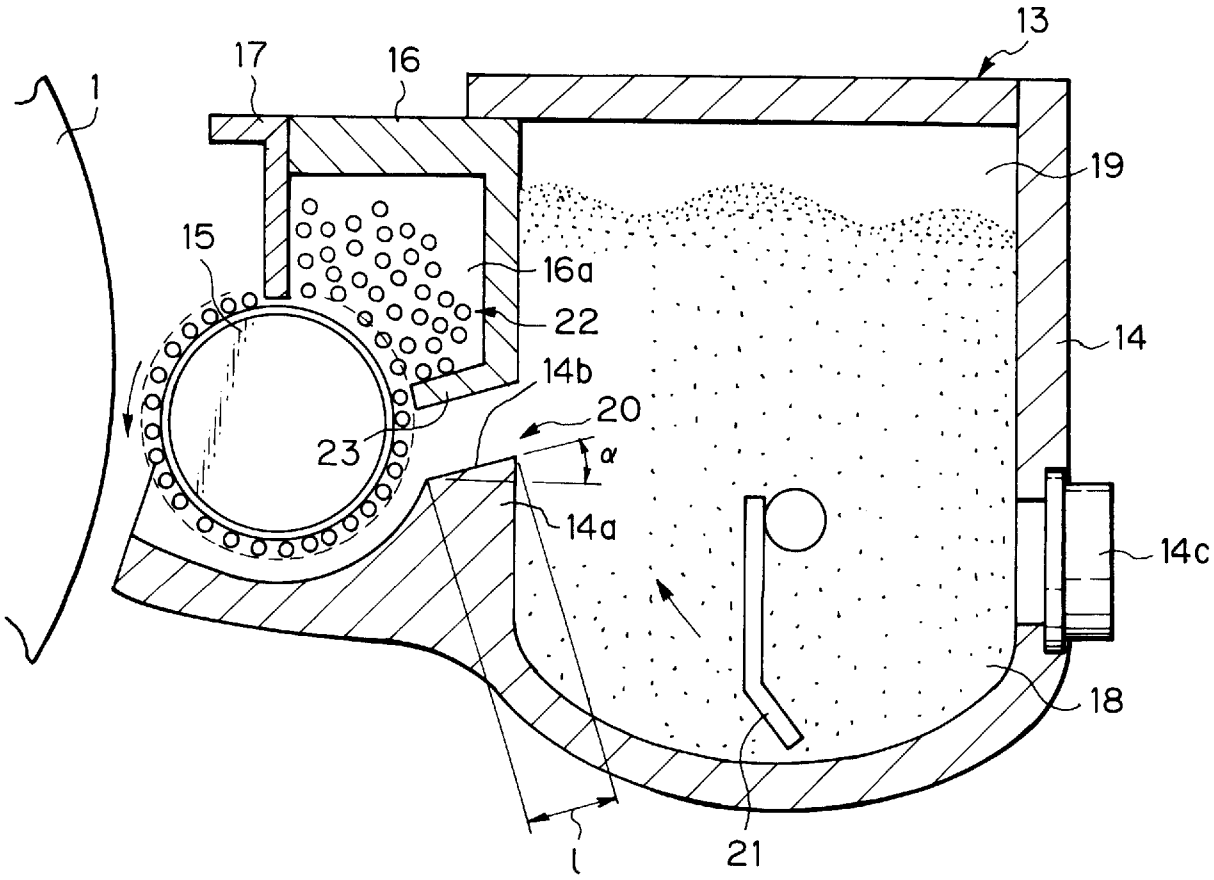
FIG. 9 is a fragmentary section showing a fourth embodiment of the present invention.

Referring to FIG. 9, a developing device 13 is positioned at one side of the drum 1 and mainly includes a casing 14, a developing sleeve or developer carrier 15, a developer storing member or developer container 16, and a first doctor blade or regulating member 17. The casing 14 forms a toner hopper 19 storing fresh toner 18. The developer container 17 is formed integrally with the casing 14 and forms a space 16*a*. A developer 22, i.e., a mixture of toner 18 and magnetic carrier particles is received in the space 16*a*. A projection 14*a* having a surface 14*b* protrudes from the portion of the casing 14 below the developer container 16. The gap between the surface 14*b* and the lower end of the developer container 16 plays the role of an opening 20 for replenishing the toner 18. An agitator 21 is disposed in the toner hopper 19 and caused to rotated by drive means, not shown. The agitator 21 feeds the toner 18 toward the opening 20 while agitating it. Toner end sensing means 14*c* is mounted on the wall of the toner hopper 19 facing the drum 1 with the intermediary of the sleeve 15. The sensing means 14*c* is responsive to a condition wherein the amount of the toner 18 in the toner hopper 19 is short.

The sleeve 15 is positioned between the drum 1 and the toner hopper 19 and caused to rotate by drive means, not shown, in a direction indicated by an arrow in FIG. 9. Magnet field generating means in the form of magnets is disposed in the sleeve 15 and unmovable relative to the developing device 13.

The first doctor blade 17 is mounted on the side of the developer container 16 opposite to the side mounted on the casing 14. A preselected gap exists between the edge of the doctor blade 17 and the periphery of the sleeve 15. A second doctor blade or regulating member 23 is mounted at its one end on the developer container 16 in the vicinity of the opening 20. The second doctor blade 23 extends out from the container 16 toward the center of the sleeve 15, i.e., in the direction in which its other end or edge obstructs the flow of the developer 22. A preselected gap separates the edge of the doctor blade 23 and the periphery of the sleeve 15.

The space 16*a* is so sized as to allow the developer 22 to be circulated over the range in which the magnetic force of the sleeve 15 acts.

The surface 14*b* of the projection 14*a* extends over a preselected length and is inclined downward from the toner hopper 19 side toward the sleeve 15 side. Assume that the carrier in the space 16*a* drops via the gap between the second doctor blade 23 and the sleeve 15 due to vibration, irregular magnetic force distribution of the magnetic field generating means, or local increase in the toner content of the developer 22. Then, the carrier is received by the surface 14*b* and moved toward the sleeve 15 along the surface 14*b*. As a result, the carrier is magnetically deposited on the sleeve 15 and conveyed to the space 16*a* thereby. This successfully obviates a decrease in the amount of carrier in the space 16*a* and thereby frees an image from irregular density in the axial direction of the sleeve 15. The surface 14*b* should preferably have an inclination $\alpha$ of about 5° and a length l of about 2 mm to 20 mm, more preferably 3 mm to 10 mm.

In operation, the toner 18 fed out from the toner hopper 19 by the agitator 21 is replenished to the developer 22 existing on the sleeve 15 via the opening 20. The sleeve 15 conveys the developer 22 taken in the toner 18 to the space 16*a*. The developer 2 existing in the space 16*a* is deposited on the sleeve 15 and conveyed to a developing position where the sleeve 15 faces the drum 1. At the developing position, only the toner 18 is transferred from the sleeve 15 to the drum 1 in order to develop a latent image formed on the drum 1.

Figure 10:
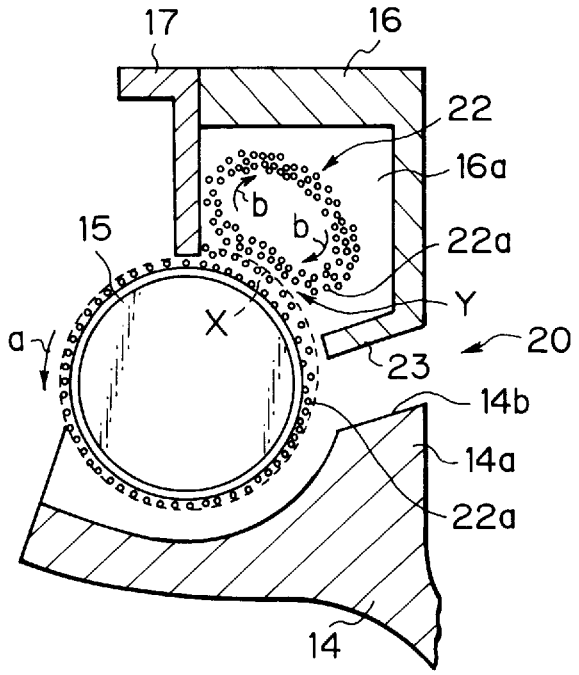
FIGS. 10–12 are fragmentary sectional side elevations demonstrating the behavior of a developer to occur in the fourth embodiment.

How the developer 22 behaves during image formation will be described hereinafter. As shown in FIG. 10, assume that a starting agent consisting only of magnetic carrier particles 22*a* is set in the developing device 13. Then, the carrier particles 22*a* are partly magnetically deposited on the sleeve 15 and partly received in the space 16*a*. The particles 22*a* received in the space 16*a* are circulated in a direction b at a speed higher than 1 mm/sec, inclusive, due to the magnetic force acting from the inside of the sleeve 15. An interface X is formed between the surface of the carrier 22*a* deposited on the sleeve 15 and that of the carrier 22*a* moving in the space 16*a*.

Subsequently, when the toner 18 is set in the toner hopper 19, it is fed to the carrier 22*a* existing on the sleeve 15 via the opening 20. As a result, the sleeve 15 bears the developer 22 which is the mixture of the toner 18 and carrier 22*a*.

The developer 22 existing in the space 16*a* exerts a force tending to stop the developer 22 being conveyed by the sleeve 15. When the toner 18 existing on the surface of the developer 22 present on the sleeve 15 is brought to the interface X, friction acting between the two parts of the developer 22 around the interface X decreases and, in turn, decreases the developer conveying force around the interface X. Consequently, the amount of the developer 22 being conveyed decreases around the interface X.

Figure 11:
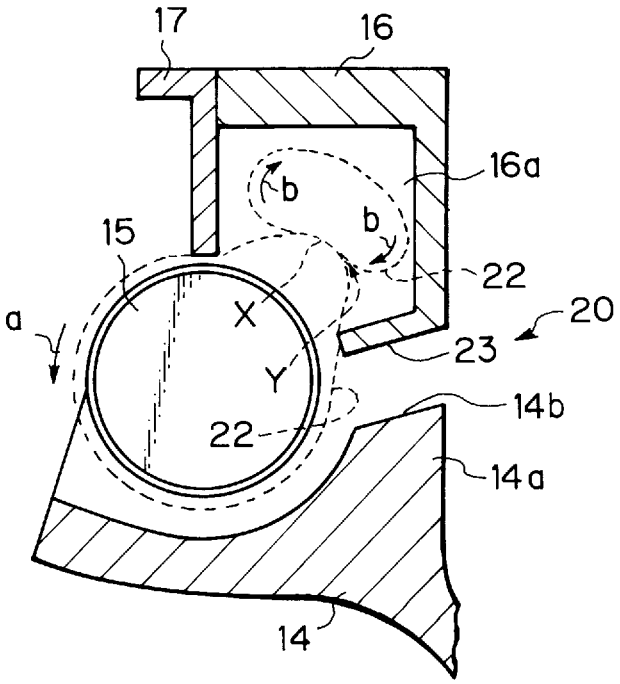

The two parts of the developer 22 join each other at a point Y. The force tending to stop the developer 22, as mentioned above, does not act on the developer 22 at the upstream side with respect to the direction of rotation of the sleeve 15. As a result, the developer 22 conveyed to the point Y and the developer 22 being conveyed along the interface X are brought out of balance with respect to the amount of conveyance. In this condition, the two parts of the developer 22 collide against each other. Consequently, as shown in FIG. 11, the point Y rises, i.e., the thickness of the developer layer containing the interface X increases. At the same time, the thickness of the developer 22 moving away from the first doctor blade 17 sequentially increases. This part of the developer 22 is scraped off by the second doctor blade 23.

Figure 12:
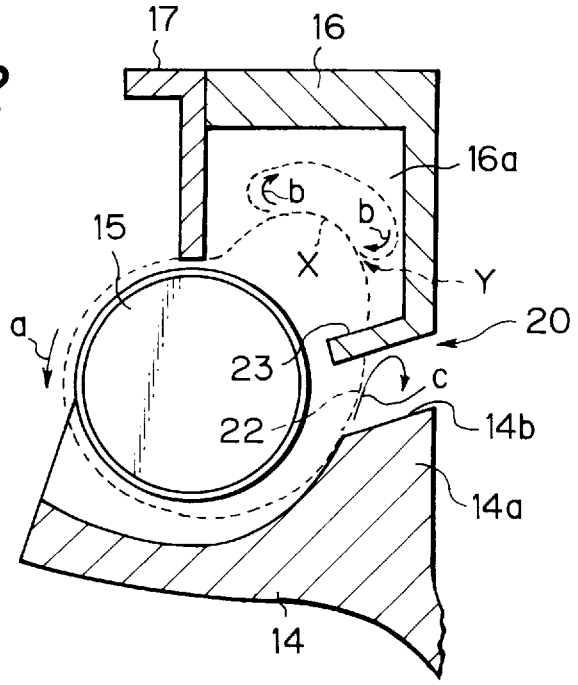

As shown in FIG. 12, when the developer 22 moved away from the first doctor blade 17 reaches a preselected toner content, the increment part of the developer 22 scraped off by the second doctor blade 23 and forming a layer closes the opening 20. Consequently, the replenishment of the toner 18 ends. At this instant, the volume of the developer 22 existing in the space 16*a* increases due to the increase in toner content and reduces the space 6*a*. This slows down the circulation of the developer 22 in the direction b.

The developer 22 scraped off by the second doctor blade 23 and closing the opening 20 moves at a speed higher than 1 mm/sec inclusive and hits against the surface 14*b* of the projection 14*a*, as indicated by an arrow c in FIG. 12. The surface 14*b* is inclined by the angle α toward the sleeve 15 and has a preselected length l, as shown in FIG. 9. Therefore, the developer 22 hit against the surface 14*b* is prevented from dropping into the toner hopper 19 despite its movement. This maintains the amount of the developer 22 constant and allows the toner replenishment to be automatically controlled at all times.

A series of researches and experiments showed that when a toner content giving a 100% carrier covering ratio Tn, taking account of the particle size of the carrier 22*a* as well as other factors, is selected to be the upper limit of toner content, desirable images free from background contamination and local omission are achievable. The carrier covering ratio Tn is produced by:

$$Tn = (\text{sum of areas occupied by } n \text{ toner particles/surface area of carrier particle}) \times 100 \qquad \text{Eq. (1)}$$

Because a single toner particle occupies an area of $2(\sqrt{3})\,r^2$ while a single carrier particle has a surface area of $4\pi(R+r)^2$, the carrier covering ratio Tn is expressed as:

$$Tn = \frac{2\sqrt{3}\,r^2 n}{4\pi\,(r+R)^2} \times 100 \qquad \text{Eq. (2)}$$

Figure 13A:
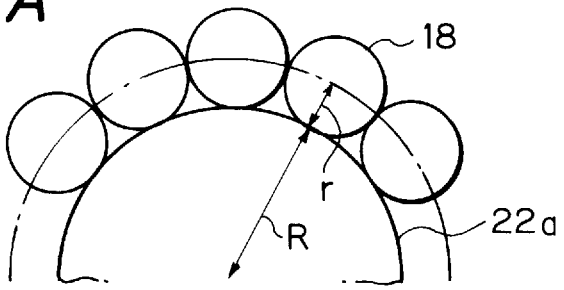
FIGS. 13A and 13B are schematic views useful for understanding a carrier covering ratio.

The toner content of the developer (wt %) is represented by weight of toner/(weight of toner+weight of carrier)×100. For a generality purpose, assume that the carrier and toner particles each has a spherical shape, and that a condition wherein n toner particles fully cover the surface of a single carrier particle in a single layer without any clearance represents a 100% covering ratio, as shown in FIG. 13A. Let the number of toner particles so covering a single carrier particle be referred to as a limit number of toner particles. While the covering ratio has conventionally been calculated by plane approximation or sphere approximation, the embodiment performs plane approximation with a practical range of ratios in radius between the toner and the carrier, as follows.

Figure 13B:
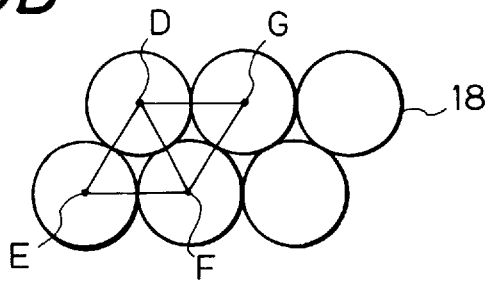

As shown in FIG. 13A, assume that the toner particles 18 and carrier particle 22*a* have radii of r and R, respectively. As shown in FIG. 13B, the limit number N of toner particles is determined by dividing the surface of a sphere whose radius is (r+R) by the area of a single parallelogram DEFG which is a substantial occupied area:

$$N = \frac{4\pi\,(r+R)^2}{2\sqrt{3}\,r^2} \qquad \text{Eq. (3)}$$

A single carrier particle and a single toner particle have a weight of $4\pi R^3\rho_c/3$ and a weight of $4\pi R^3\rho_t/3$, respectively. Therefore, the toner content C of the developer 22 (wt %) may be represented by the number n of toner particles existing on the carrier surface, as follows:

$$C = \frac{100\,nr^3\rho_t}{nr^3\rho_t + R^3\rho_c} \qquad \text{Eq. (4)}$$

where r is the radius of the toner particles (μm), R is the radius of the carrier particles (μm), $\rho_t$ is the true specific gravity of the toner particles (g/cm$^3$), and ρc is the true specific gravity of the carrier particles (g/cm$^3$).

By deleting n of the Eq. (2) and (4) and rearranging them, there is obtained:

$$Tn = \frac{100C\sqrt{3}}{2\pi(100-C)\cdot\,(1+r/R)^2\cdot(r/R)\cdot(\rho_t/\rho_c)} \qquad \text{Eq. (5)}$$

Figure 14A:
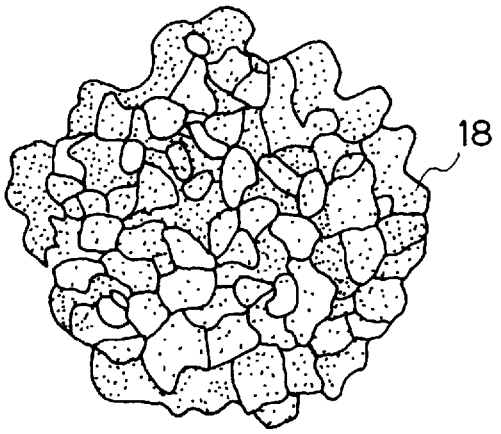
FIG. 14A is a sketch showing the deposition of toner particles on a carrier particle particular to the fourth embodiment and observed when the carrier covering ratio was 100%.
Figure 14B:
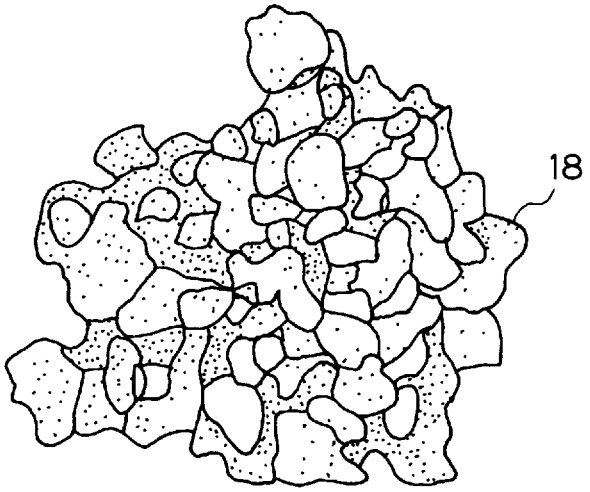
FIG. 14B is a sketch similar to FIG. 14A, showing the toner deposition observed when the carrier covering ratio was 169%.

FIG. 14A is a sketch showing the toner particles 18 deposited on the carrier particle 22*a* when the covering ratio was 100%. As shown, the toner particles 18 deposit on the carrier particle 22*a* in a single layer without any clearance. FIG. 14B is a sketch showing the toner particles deposited on the carrier particle 22*a* when the covering ratio was 196%. As shown, the toner particles 18 cover the carrier particle 22*a* in multiple layers. This was confirmed by experiments.

However, the problem with the developer whose carrier covering ratio is 100% or above is that its particles repeatedly rub against each other in the space 16*a*. While the toner particles 18 are charged by friction acting between them and the carrier particles 22*a*, the covering ratio of 100% or above causes the toner particles 18 to cover the toner particles 18 already covering the carrier particles 22*a*. As a result, the toner particles 18 rub against each other and are partly charged to the positive polarity and partly charged to the negative polarity. If the toner particles 18 are charged to the negative polarity, then they will prevent the positively charged toner particles 18 from depositing on a latent image in the expected manner and will thereby bring about troubles including background contamination.

As stated above, if a toner content giving a covering ratio less than 100% is selected as the upper limit of toner content, and if a developer or carrier capable of implementing such an upper limit is set in the space 16*a*, attractive toner images free from defects are achievable.

As the toner 18 is sequentially consumed at the developing position, the toner content decreases on the interface X with the result that the toner conveying force increases at the interface X. The increasing conveying force exerts a force tending to pull back the thickened layer of the developer 22. Consequently, the developer 22 is brought from the condition shown in FIG. 12 to the condition shown in FIG. 11. As a result, the toner replenishment is resumed and continued until the preselected toner content has been reached.

The space 16*a* is broad enough for the developer 22 to move over the range in which the magnetic force of the sleeve 15 acts, as stated above. Therefore, the developer 22 in the space 16*a* can be constantly circulated at a speed of higher than 1 mm/sec inclusive without regard to the toner content thereof. In this condition, the developer 22 moved away from the first doctor blade 17 or the developing position and the developer 22 existing in the space 16*a* are replaced with each other little by little. Therefore, the entire developer 22 set in the space 16*a* can be used. This scatters the stress acting on the developer 22 and thereby prevents the films of the carrier particles from coming off or decelerates the spending of the toner particles, i.e., extends the service life of the developer 22. It follows that the developing device is capable of covering, with a miniature configuration, even the high-speed range dealing with a great number of papers.

Figure 15:
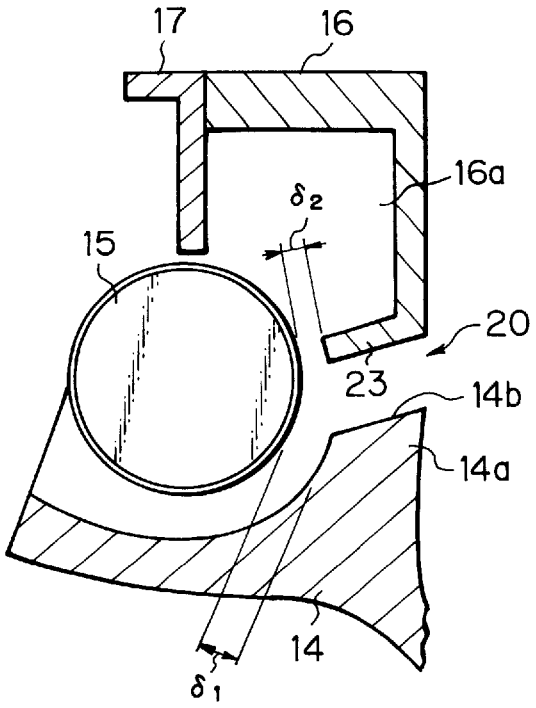
FIG. 15 is a fragmentary sectional side elevation showing a modification of the fourth embodiment.

As shown in FIG. 15, a gap δ1 between the projection 14*a* and the sleeve 15 is selected to be greater than a gap δ2 between the edge of the second doctor blade 23 and the sleeve 15. With this configuration, it is possible to control the replenishment of the toner 18 with the developer 22 forming a thin layer on the sleeve 15. It follows that even when an image to be copied has a broad area, the consumption of the toner 18 can be made up for immediately. Hence, such an image can be continuously reproduced on a number of papers.

Figure 16:
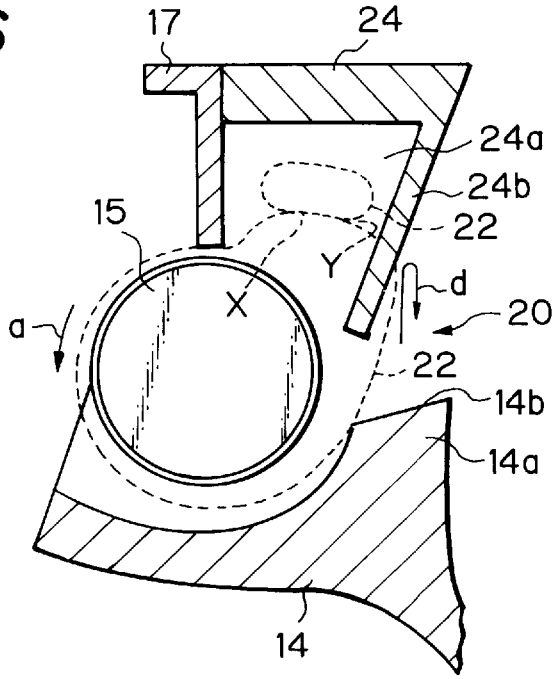
FIG. 16 is a view similar to FIG. 15, showing another modification of the fourth embodiment.

FIG. 16 shows a modification of this embodiment. As shown, a developer storing member or container 24 is used in place of the previous container 16. The container 24 has a wall 24*b* facing the first doctor blade 17 and inclined toward the sleeve 15. The wall 24*b* plays the role of the second doctor blade 23. The container 24 also has a space 24*a* broad enough for the developer 22 to move over the range in which the magnetic force of the sleeve 15 acts.

5th Embodiment

Figure 17:
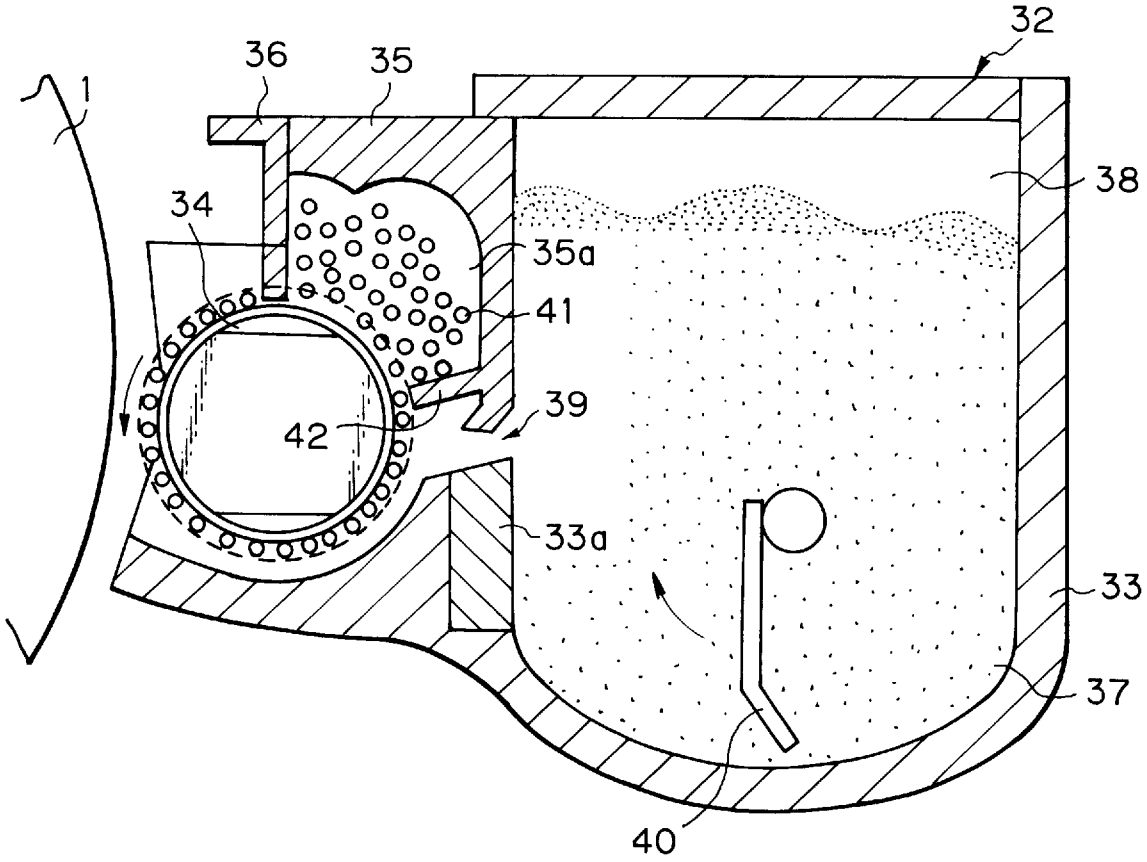
FIG. 17 is a fragmentary section showing a fifth embodiment of the present invention.

Referring to FIG. 17, a developing device 32 is positioned at one side of the drum 1 and mainly includes a casing 33, a developing sleeve or developer carrier 34, a developer storing member or developer container 35, and a first doctor blade or regulating member 36. The casing 33 forms a toner hopper 38 storing fresh toner 37. The developer container 35 is formed integrally with the casing 33 and forms a space 45*a*. A developer 41, i.e., a mixture of toner 37 and magnetic carrier particles is received in the space 45*a*. A member 33*a* is positioned below the container 35 and provided integrally with the casing 33. The gap between the lower end of the container 35 and the upper end of the member 33*a* plays the role of an opening 39 for replenishing the toner 37. An agitator 40 is disposed in the toner hopper 38 and caused to rotated by drive means, not shown. The agitator 40 feeds the toner 37 toward the opening 39 while agitating it.

The sleeve 34 is positioned between the drum 1 and the toner hopper 38 and caused to rotate by drive means, not shown, in a direction indicated by an arrow in FIG. 17. A magnet is disposed in the sleeve 34 and unmovable relative to the developing device 32. The magnet has poles P1, P2, P3 and P4. The pole P1 faces the drum 1 while the poles P2 and P3 face a developer passage defined between the casing 33 and the sleeve 34. The pole P4 faces the space 35*a*.

The first doctor blade 36 is mounted on the side of the developer container 35 opposite to the side mounted on the casing 33. A preselected gap exists between the edge of the doctor blade 36 and the periphery of the sleeve 34. A second doctor blade or regulating member 42 is mounted at its one end on the developer container 35 in the vicinity of the opening 39. A preselected gap separates the edge of the doctor blade 42 and the periphery of the sleeve 34.

In operation, the toner 37 fed out from the toner hopper 38 by the agitator 40 is replenished to the developer 41 existing on the sleeve 34 via the opening 39. The sleeve 34 conveys the developer 41 taken in the toner 37 to the space 35*a*. The developer 41 existing in the space 35*a* is deposited on the sleeve 34 and conveyed to a developing position where the sleeve 34 faces the drum 1. At the developing position, only the toner 37 is transferred from the sleeve 34 to the drum 1 in order to develop a latent image formed on the drum 1.

Figure 18:
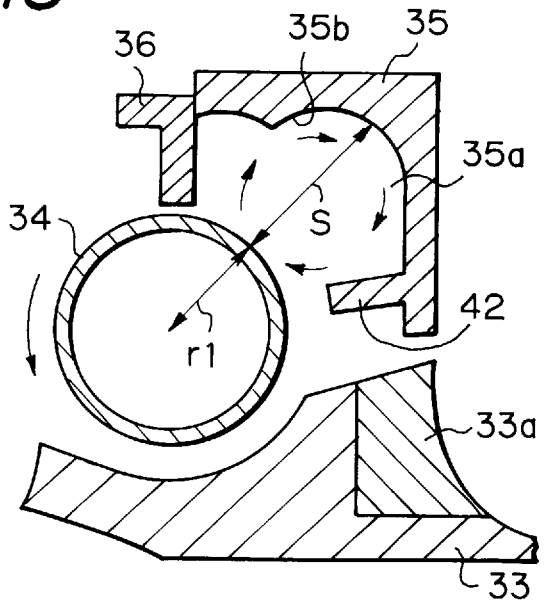
FIGS. 18–21 are fragmentary sectional side elevations showing functions particular to the fifth embodiment.

During the above operation, the developer 41 existing in the space 35*a* continuously rotates in a direction indicated by an arrow in FIG. 18. The toner 37 is introduced into the space 35*a* via the gap between the edge of the second doctor blade 42 and the periphery of the sleeve 34. The replenishment of the toner 37 into the space 35*a* is effected by the drag (increase in gravity and volume) of the developer 41 present in the space 35*a*. The following facts were found by experiments. First, the toner content of the developer 41 was measured while varying the maximum distance S between the inner wall 35*b* of the space 35*a* and the surface of the sleeve 34. When the maximum distance S was smaller than the radius r1 of the sleeve 34, the volume and gravity, i.e., drag of the developer 41 in the space 35*a* increased before the target content was reached, reducing the toner replenishing time. Consequently, the upper limit of toner content was reached before the target toner content, making it impossible to implement an optimal toner content range.

When the amount of the developer 41 to be set in the space 35*a* was reduced in accordance with the decrease in the space 35*a*, the developer 41 failed to move unless the magnetic force of the pole P4 was weakened. When the force of the pole P4 was reduced until the developer 41 started to move, the force of the pole P1 was also reduced for production reasons and caused the carrier to deposit on the drum 1. Even if the force of the pole P1 were maintained, the amount of the developer 41 passing the first doctor blade 36 would become unstable and render an image irregular in the axial direction of the sleeve 34.

Figure 19:
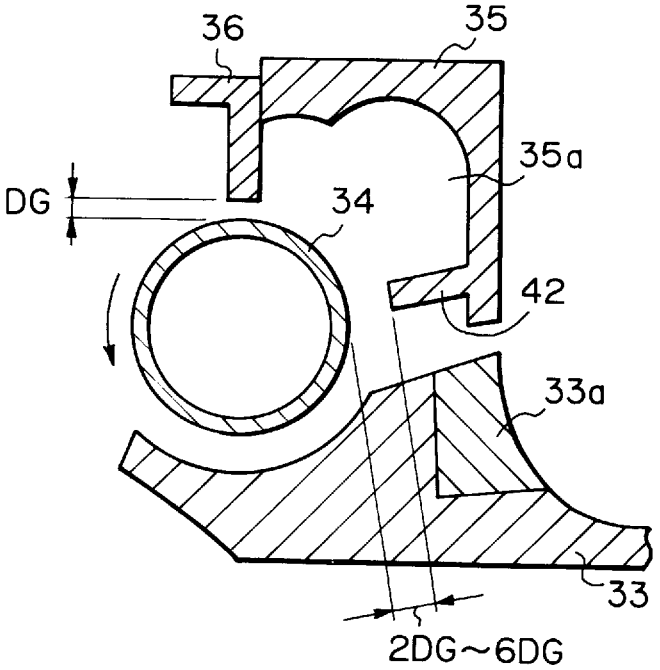

As shown in FIG. 19, the amount of the toner 37 to be replenished into the space 35*a* is effected by the gap between the doctor blade 42 and the periphery of the sleeve 34. The toner content of the developer 41 was measured while varying the above gap. When the gap was less than twice a gap DG between the edge of the doctor blade 36 and the periphery of the sleeve 34, the developer 41 was blocked by the doctor blade in a substantial amount and caused to overflow. In addition, it was difficult for the toner 37 to enter the space 35*a*, resulting in a decrease in toner content. When the gap between the doctor blade 42 and the sleeve 34 was more than six times the gap DG, the developer 41 was found to be irregular in amount in the axial direction of the sleeve 34 when introduced into the space 35*a*; the toner 37 was easily introduced into the developer 41 at some portions, but difficult to be done so at the other portions.

Figure 20:
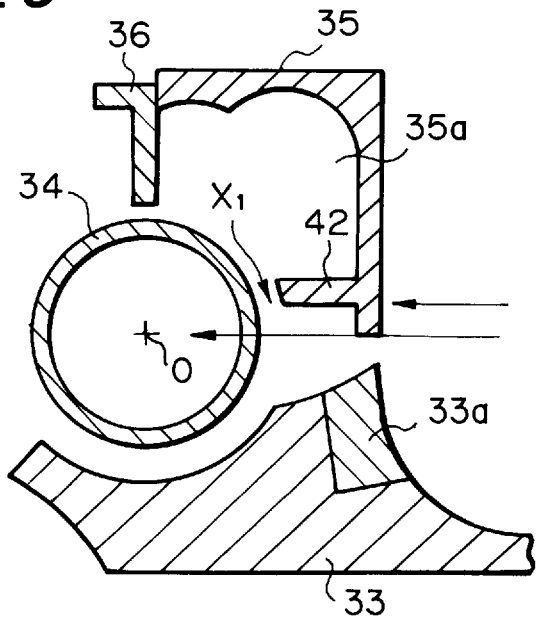

As shown in FIG. 20, the replenishment of the toner 37 into the space 35*a* is further effected by a position X1 to which the second doctor blade 42 extends in the direction of height. If the position X1 is below the center O of the sleeve 34, the replenishing position of the toner 37 is lowered and renders the replenishment difficult due to gravity.

Figure 21:
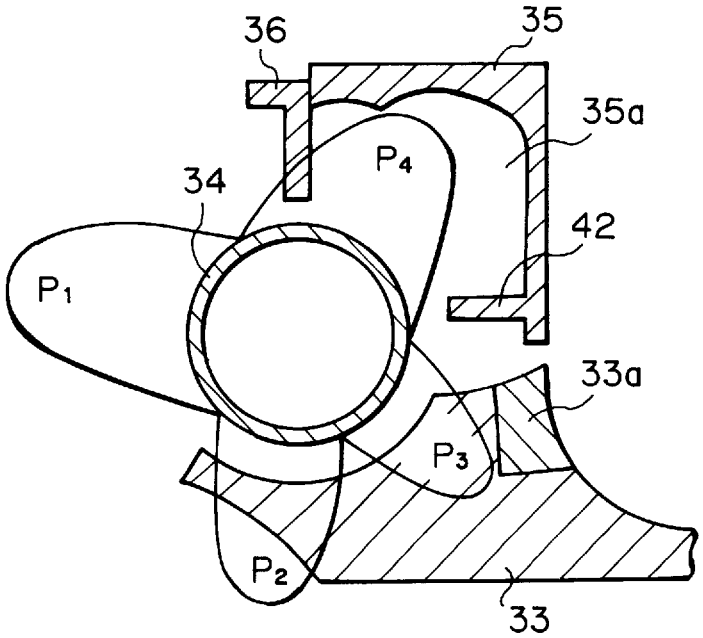

As shown in FIG. 21, the movement of the developer 41 in the space 35 is also effected by the forces of the magnet disposed in the sleeve 34. The movement of the developer 41 in the space 35*a* was observed by varying the force of the pole P1 while maintaining the forces of the poles P2, P3 and P4 constant. When the force of the pole P1 was more than 1.2 times, inclusive, as great as that of the pole P4 (e.g. the pole P1 exerts a force of greater than 72.0 milliteslas while the pole P4 exerts a force of 60.0 milliteslas, the developer 41 moved actively and moved away from the doctor blade 36 in a stable amount.

Figure 22:
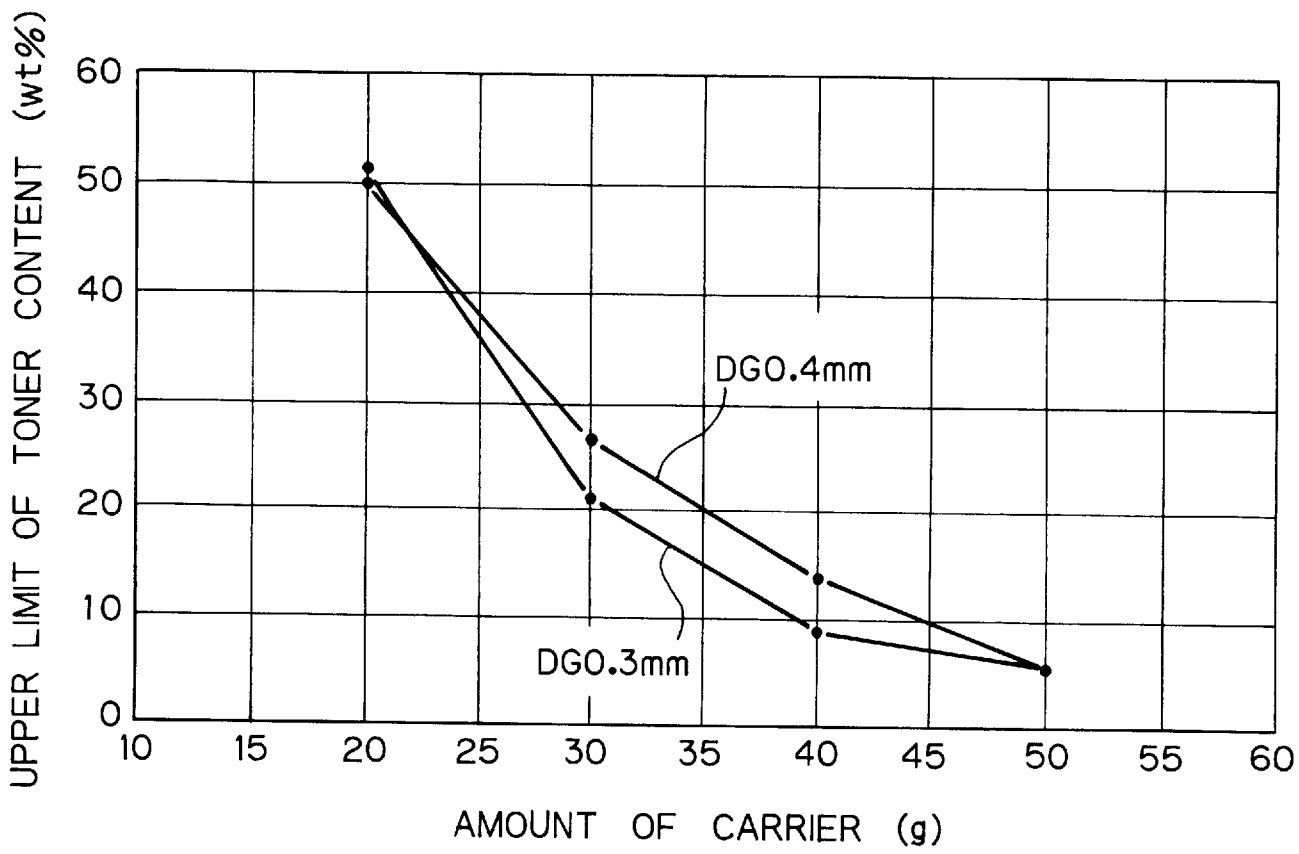
FIG. 22 is a graph showing a relation between the amount of carrier included in a developer and the upper limit of toner content particular to the fifth embodiment.

FIG. 22 shows a relation between the amount of carrier contained in the developer 41 and the upper limit of toner content. As shown, the duration of replenishment of the toner 37 into the space 35*a* and therefore the toner content decreases with an increase in the amount of carrier set in the space 35*a*. Also, the upper limit of toner content can be increased if the gap DG is increased.

In summary, the fourth and fifth embodiments described above have various advantages as enumerated below.

(1) A second regulating member regulates the passage of a developer increased in amount while the regulated developer controls the replenishment of toner. As a result, the toner replenishment, i.e., toner content can be automatically controlled by a simple arrangement.

(2) A toner content giving a 100% carrier covering ratio is selected to be an adequate content. The toner fully covering the carrier prevents the films of the carrier from being shaved off and thereby extends the life of the developer.

(3) A developer layer whose thickness matches the toner content thereof is formed around an opening used to replenish the toner. Hence, the toner replenishment can be automatically controlled, so that the device is small size and low cost.

(4) The developer moves at a speed higher than 1 mm/sec, inclusive, when forming the layer at the above opening. Therefore, the developer can be constantly agitated at the replenishing portion. This prevents the charge of the toner from falling and thereby frees images from defects.

(5) A space in which the developer stays is broad enough for the developer to be circulated. This confines the toner content in the above space in a preselected range without resorting to a toner content sensor.

(6) The developer existing at the replenishing portion is uniformly distributed by a second regulating member in the axial direction of a developer carrier, allowing the toner to be replenished uniformly. This frees images from irregularity.

(7) While the developer existing in the above portion is uniformly distributed by the second regulating member, it is fed to the space in an adequate amount. This also allows the toner to be replenished uniformly and frees images from irregularity.

(8) The edge of the second regulating member is positioned at a higher level than the center of rotation of the developer carrier. This reduces the limitation on the movement of the developer at the replenishing portion and ascribable to its own weight. As a result, the toner content can be controlled on the basis of the amount of the developer which can be retained by magnetism.

(9) The magnetic force of a first magnetic pole is so increased as to activate the movement of the developer in the space while preventing it from depositing on the carrier. This insures attractive images free from irregularity in the axial direction of the developer carrier.

Various modifications will become possible for those skilled in the art after receiving the teachings of the present disclosure without departing from the scope thereof.

What is claimed is:

1. A developing device comprising:

a developer carrier for conveying a developer consisting essentially of toner and magnetic particles deposited thereon;

magnetic field generating means disposed in said developer carrier and for exposing said developer carrier to a magnetic field;

a regulating member for regulating an amount of the developer deposited on said developer carrier;

a developer storing member separated by a space from said developer carrier, said space receiving a portion of the developer removed by said regulating member;

a toner storing section adjoining said space from an upstream side with respect to a direction in which said developer carrier conveys the developer toward said space, and formed with an opening facing said developing carrier for toner replenishment; and a spread preventing member for preventing the portion of developer removed by said regulating member from spreading outward in an axial direction of said developer carrier.

2. A device as claimed in claim 1, wherein said spread preventing member extends toward said developer carrier at a side of said space over an entire width of said space.

3. A device as claimed in claim 1, wherein said spread preventing member extends at a side of said space and extends from said regulating member to a position where the toner replenished via said opening and staying in contact with the developer existing in said space and said developer in said space contact each other.

4. A device as claimed in claim 3, wherein said spread preventing member comprises two spread preventing members located at both sides of said space, and wherein said two spread preventing members delimit, in a range of a distance therebetween, a range in which the developer exists in said space.

5. A device as claimed in claim 1, wherein said spread preventing member comprises two spread preventing members located at both sides of said space, and wherein a range of a distance between said two spread preventing members lies in a range of influence by the magnetic field generated by said magnetic field generating means and acting on said space.

6. A device as claimed in claim 5, wherein said range of the distance is the same as said range of influence of the magnetic field.

7. A device as claimed in claim 5, wherein said range of the distance lies in a range in which the magnetic force of the magnetic field is uniform in a widthwise direction.

8. A device as claimed in claim 1, further comprising a seal fitted on a surface of said spread preventing member facing said developer carrier, wherein said seal contacts said developer carrier.

9. A device as claimed in claim 1, wherein said developer storing member is removable from a body of said device, said device further comprising a seal removably attached to said developer storing member filled with the developer.

10. A device as claimed in claim 1, further comprising a casing including projections protruding from a bottom wall of said casing toward a downstream side in said direction so as to be sandwiched between a surface of said spread preventing member facing said developer carrier and said developer carrier.

11. A developing device comprising:

a developer carrier for conveying a developer consisting essentially of toner and magnetic particles and deposited thereon;

magnetic field generating means disposed in said developer carrier;

a regulating member for regulating an amount of the developer deposited on said developer carrier;

a developer storing member forming between said developer storing member and said developer carrier a space for causing the developer blocked by said regulating member to stay;

a toner storing section adjoining said space from an upstream side with respect to a direction in which said developer carrier conveys the developer toward said space, and formed with an opening for toner replenishment facing said image carrier; and a pair of side walls protruding from opposite end portions of said developer storing member with respect to a lengthwise direction of said developer storing member, and positioned outside of an effective developing range in which a toner image can be effectively formed in a direction substantially perpendicular to said direction;

wherein surfaces of said pair of side walls facing a surface of said developer carrier are spaced from said surface by a distance capable of restricting a movement of the developer on said developer carrier in said direction substantially perpendicular to said direction in which said developer carrier conveys the developer.

12. A device as claimed in claim 11, further comprising seals fitted on said surfaces of said pair of side walls and contacting said developer carrier.

13. A device as claimed in claim 11, wherein said developer storing member is removably mounted to a body of said device, said device further comprising a seal removably sealing said developer storing member filled with the developer beforehand.

14. A device as claimed in claim 11, further comprising a casing including projections protruding from a bottom wall of said casing toward a downstream side in said direction in such a manner as to be sandwiched between a surface of said spread preventing member facing said developer carrier and said developer carrier.

15. A developing device comprising:

a developer carrier including magnetic field generating means thereinside, for conveying a developer consisting essentially of toner and magnetic particles and deposited on said developer carrier;

a first regulating member for regulating an amount of the developer being conveyed by said image carrier;

a space for causing the developer scraped off by said first regulating member to stay;

a toner storing section adjoining said space, for feeding toner to said developer carrier; and a second regulating member disposed in said space upstream of said first regulating member with respect to a direction in which said developer carrier conveys the developer, wherein said second regulating member is spaced from said developer carrier such that when the developer forming a layer on said developer carrier increases in thickness due to an increase in a toner content of the developer, said second regulating member restricts an increment of the developer;

whereby a condition in which the developer and the toner contact each other is varied in accordance with variation of the toner content of the developer on said developer carrier to thereby vary a condition in which the developer on said developer carrier takes in the toner.

16. A device as claimed in claim 15, wherein the developer in said space moves within said space without regard to the variation of the toner content of the developer on said developer carrier.

17. A device as claimed in claim 16, wherein when the developer on said developer carrier reaches a preselected toner content, the developer blocked by said second regulating member accumulates at a position where the developer on said developer carrier and the toner contact each other to thereby block said position and interrupt replenishment of the toner into the developer.

18. A device as claimed in claim 17, wherein the developer on said developer carrier reaches an optimal toner content when a carrier covering ratio Tn produced by a following equation is 100%:

$$Tn = \frac{100C\sqrt{3}}{2\pi(100 - C) \cdot (1 + r/R)^2 \cdot (r/R) \cdot (\rho_t/\rho_c)}$$

where C is the toner content of the developer (wt %), R is a radius of carrier particles ($\mu$m), r is a radius of toner particles ($\mu$m), $\rho_t$ is a true specific gravity of the toner particles (g/cm$^3$), and ρc is a true specific gravity of the carrier particles (g/cm$^3$).

19. A device as claimed in claim 16, wherein when the developer on said developer carrier reaches a preselected toner concentration, the developer moves at a speed higher than 1 mm/sec inclusive within said space.

20. A device as claimed in claim 19, wherein the developer on said developer carrier reaches an optimal toner content when a carrier covering ratio Tn produced by a following equation is 100%:

$$Tn = \frac{100C\sqrt{3}}{2\pi(100 - C) \cdot (1 + r/R)^2 \cdot (r/R) \cdot (\rho_t/\rho_c)}$$

where C is the toner content of the developer (wt %), R is a radius of carrier particles ($\mu$m), r is a radius of toner particles (μm), $\rho_t$ is a true specific gravity of the toner particles (g/cm$^3$), and ρc is a true specific gravity of the carrier particles (g/cm$^3$).

21. A device as claimed in claim 16, wherein said second regulating member is so oriented as to obstruct a flow of the developer adjoining the surface of said developer carrier.

22. A device as claimed in claim 15, wherein when the developer on said developer carrier reaches a preselected toner content, the developer blocked by said second regulating member accumulates at a position where the developer on said developer carrier and the toner contact each other to thereby block said position and interrupt replenishment of the toner into the developer.

23. A device as claimed in claim 22, wherein when the developer on said developer carrier reaches a preselected toner concentration, the developer moves at a speed higher than 1 mm/sec inclusive within said space.

24. A device as claimed in claim 23, wherein the developer on said developer carrier reaches an optimal toner content when a carrier covering ratio Tn produced by a following equation is 100%:

$$Tn = \frac{100C\sqrt{3}}{2\pi(100 - C) \cdot (1 + r/R)^2 \cdot (r/R) \cdot (\rho_t/\rho_c)}$$

where C is the toner content of the developer (wt %), R is a radius of carrier particles (μm), r is a radius of toner particles (μm), $\rho_t$ is a true specific gravity of the toner particles (g/cm$^3$), and ρc is a true specific gravity of the carrier particles (g/cm$^3$).

25. A device as claimed in claim 22, wherein the developer on said developer carrier reaches an optimal toner content when a carrier covering ratio Tn produced by a following equation is 100%:

$$Tn = \frac{100C\sqrt{3}}{2\pi(100 - C) \cdot (1 + r/R)^2 \cdot (r/R) \cdot (\rho_t/\rho_c)}$$

where C is the toner content of the developer (wt %), R is a radius of carrier particles (μm), r is a radius of toner particles (μm), $\rho_t$ is a true specific gravity of the toner particles (g/cm$^3$), and ρc is a true specific gravity of the carrier particles (g/cm$^3$).

26. A device as claimed in claim 15, wherein when the developer on said developer carrier reaches a preselected toner concentration, the developer moves at a speed higher than 1 mm/sec inclusive within said space.

27. A device as claimed in claim 26, wherein t he developer on said developer carrier reaches an optimal toner content when a carrier covering ratio Tn produced by a following equation is 100%:

$$Tn = \frac{100C\sqrt{3}}{2\pi(100 - C) \cdot (1 + r/R)^2 \cdot (r/R) \cdot (\rho_t/\rho_c)}$$

where C is the toner content of the developer (wt %), R is a radius of carrier particles (μm), r is a radius of toner particles (μm), $\rho_t$ is a true specific gravity of the toner particles (g/cm$^3$), and ρc is a true specific gravity of the carrier particles (g/cm$^3$).

28. A device as claimed in claim 15, wherein the developer on said developer carrier reaches an optimal toner content when a carrier covering ratio Tn produced by a following equation is 100%:

$$Tn = \frac{100C\sqrt{3}}{2\pi(100 - C) \cdot (1 + r/R)^2 \cdot (r/R) \cdot (\rho_t/\rho_c)}$$

where C is the toner content of the developer (wt %), R is a radius of carrier particles (μm), r is a radius of toner particles (μm), $\rho_t$ is a true specific gravity of the toner particles (g/cm$^3$), and ρc is a true specific gravity of the carrier particles (g/cm$^3$).

29. A developing device comprising:

a developer carrier for conveying a developer consisting essentially of toner and magnetic particles and deposited thereon;

a first regulating member for regulating a thickness of the developer forming a layer on said developer carrier and being conveyed by said developer carrier;

a space positioned upstream of said first regulating member in a direction in which said developer carrier conveys the developer, for receiving the developer; and a toner storing section adjoining said space and including an opening for feeding toner to said developer carrier, wherein said opening is formed by a second regulating member and a surface facing said second regulating member and each having a preselected length and each being spaced a particular distance from said developer carrier, and wherein said opening provides communicating between said space and said toner storing section;

wherein the space between said second regulating member and said developer carrier and the space between said surface and said developer carrier are selected such that the developer forms a thicker layer around said opening than on a part of said developer carrier moved away from said first regulating member.

30. A device as claimed in claim 29, wherein the developer forming the layer around said opening varies in thickness in accordance with variation of toner content of the developer deposited on said developer carrier.

31. A device as claimed in claim 30, wherein the developer forming the layer around said opening in accordance with the variation of the toner content moves at a speed higher than 1 mm/sec inclusive.

32. A device as claimed in claim 31, wherein a surface of the layer of the developer deposited on said developer carrier and a surface of the developer being circulated in said space in a direction opposite to said direction form an interface, and wherein a force conveying the developer deposited on said developer carrier varies at said interface in accordance with a toner content of the developer deposited on said developer carrier.

33. A device as claimed in claim 29, wherein said second regulating member is so oriented as to obstruct a flow of the developer adjoining a surface of said developer carrier.

34. A device as claimed in claim 29, wherein a space δ1 between said surface facing said second regulating member and said developer carrier is greater than a space δ2 between said second regulating member and said developer carrier.

35. A developing device comprising:

a space for retaining therein a two-ingredient type developer consisting essentially of toner and magnetic carrier particles;

a rotatable developer carrier facing an image carrier and including therein magnetic field generating means;

a first regulating member for regulating a thickness of the developer so as to form a layer on said developer carrier; and a toner storing section including therein rotatable toner feeding means;

wherein a maximum distance between an inner wall of said space and a surface of said developer carrier facing said inner wall is greater than a radius of said developer carrier;

whereby the toner stored in said toner storing section is stored such a manner so as to contact the developer being fed to said space due to a movement of the developer in said space.

36. A device as claimed in claim 35, further comprising a second regulating member positioned upstream of a portion of said inner wall of said space having the maximum distance with respect to a direction of rotation of said developer carrier, for regulating an amount of the developer to enter said space.

37. A device as claimed in claim 36, wherein said magnetic field generating means includes a first pole facing said image carrier and a second pole facing said space, and wherein said first pole exerts a magnetic force more than 1.2 times, inclusive, as great as a magnetic force of said second pole.

38. A device as claimed in claim 35, wherein said magnetic field generating means includes a first pole facing said image carrier and a second pole facing said space, and wherein said first pole exerts a magnetic force more than 1.2 times, inclusive, as great as a magnetic force of said second pole.

39. A developing device comprising:

a space for causing a two-ingredient type developer consisting essentially of toner and magnetic carrier particles to stay therein;

a rotatable developer carrier facing an image carrier and including magnetic field generating means thereinside;

a first regulating member for regulating a thickness of the developer forming a layer on said developer carrier;

a toner storing section including rotatable toner feeding means thereinside; and a second regulating member positioned upstream of a portion of an inner wall of said space having a maximum distance to a surface of said developer carrier with respect to a direction of rotation of said developer carrier, for regulating an amount of the developer to enter said space;

wherein a distance between said second regulating member and a surface of said developer carrier is twice to six times as great as a distance between said first regulating member and said surface of said developer carrier;

whereby the toner stored in said toner storing section in such a manner as to contact the developer is fed to said space due to a movement of the developer in said space.

40. A developing device comprising:

a space for causing a two-ingredient type developer consisting essentially of toner and magnetic carrier particles to stay therein;

a rotatable developer carrier facing an image carrier and including magnetic field generating means thereinside;

a first regulating member for regulating a thickness of the developer forming a layer on said developer carrier;

a toner storing section including rotatable toner feeding means thereinside; and a second regulating member positioned upstream of a portion of an inner wall of said space having a maximum distance to a surface of said developer carrier with respect to a direction of rotation of said developer carrier, for regulating an amount of the developer to enter said space;

wherein a free edge of said second regulating member is positioned at a higher level than a center of rotation of said developer carrier;

whereby the toner stored in said toner storing section in such a manner as to contact the developer is fed to said space due to a movement of the developer in said space.

41. A developing device comprising:

a developer carrier for conveying a developer consisting essentially of toner and magnetic carrier particles deposited thereon;

magnetic field generating means disposed in said developer carrier and for exposing said developer carrier to a magnetic field;

a regulating member for regulating an amount of the developer deposited on said developer carrier;

a space between the developer carrier and the toner storing section for retaining a portion of the developer removed by said regulating member; and a toner storing section adjoining said space and configured to store toner therein, wherein the toner remains in contact with the developer deposited on said developer carrier;

wherein said space has an inner bottom wall with respect to a direction of gravity inclined downward from a toner storing section side toward a developer carrier side.

* * * * *